US007249694B2

(12) United States Patent
Masuda

(10) Patent No.: US 7,249,694 B2
(45) Date of Patent: Jul. 31, 2007

(54) VALVE MECHANISM FOR TUBE-TYPE FLUID CONTAINER

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 203 days.

(21) Appl. No.: 10/619,205

(22) Filed: Jul. 14, 2003

(65) Prior Publication Data

US 2004/0050872 A1 Mar. 18, 2004

(30) Foreign Application Priority Data

| | | |
|---|---|---|
| Jul. 26, 2002 | (JP) | 2002-218330 |
| Nov. 14, 2002 | (JP) | 2002-330153 |
| Dec. 5, 2002 | (JP) | 2002-354048 |
| Feb. 5, 2003 | (JP) | 2003-028589 |

(51) Int. Cl.
*B65D 35/38* (2006.01)

(52) U.S. Cl. ..... 222/212; 222/215; 222/496

(58) Field of Classification Search ..... 222/496, 222/212, 215; 137/854, 857
See application file for complete search history.

(56) References Cited

U.S. PATENT DOCUMENTS

| | | | | |
|---|---|---|---|---|
| 2,777,612 A | | 1/1957 | Bensen | |
| 3,438,554 A | * | 4/1969 | Schwartzman | 222/496 |
| 3,456,650 A | * | 7/1969 | Schwartzman | 604/298 |
| 3,506,162 A | * | 4/1970 | Schwartzman | 222/207 |
| 3,592,365 A | | 7/1971 | Schwartzman | |
| 3,705,668 A | | 12/1972 | Schwartzman | |
| 3,794,213 A | * | 2/1974 | Schwartzman | 222/107 |
| 3,849,863 A | | 11/1974 | Schwartzman | |
| 3,874,563 A | * | 4/1975 | Schwartzman | 222/213 |
| 3,935,972 A | * | 2/1976 | Tsunemoto et al. | 222/146.5 |
| 4,811,871 A | * | 3/1989 | Wass et al. | 222/477 |
| 6,062,248 A | * | 5/2000 | Boelkins | 137/118.02 |
| 7,082,967 B2 | * | 8/2006 | Sarajian et al. | 137/854 |
| 2002/0005415 A1 | | 1/2002 | De Laforcade | |

FOREIGN PATENT DOCUMENTS

WO WO 89/01104 A 2/1989

* cited by examiner

*Primary Examiner*—James Hook
(74) *Attorney, Agent, or Firm*—Knobbe, Martens, Olson & Bear LLP

(57) ABSTRACT

A valve mechanism adapted for a fluid-discharging port of a tube-type fluid container, comprising: a valve seat portion 40 having an opening 41 through which a fluid flows; a valve portion 20 comprising a valve body 21 having a shape corresponding to the opening 41, and a shaft 22 connected to the valve body 21 and extending downward from the valve body 22; and a valve support portion 30 comprising: (i) a bottom plate 39 to which a tip of the shaft 22 is connected; (ii) an annular support 35 fixedly connected to the valve seat portion 40; and (iii) multiple connectors 32 connecting the bottom plate 39 and the annular support 31, the connectors 32 elastically urging the bottom plate 39 downward to close the opening 41 with the valve body 21 and being bendable as the bottom plate 39 moves upward and pushes the valve portion 20 to open the opening 41.

15 Claims, 40 Drawing Sheets

VALVE MECHANISM FOR TUBE-TYPE FLUID CONTAINER

BACKGROUND OF THE INVENTION

1. Field of the Invention

The present invention relates to a valve mechanism, particularly to a valve mechanism which can be used for a tube-type fluid container. Further, the present invention relates to a tube-type fluid container storing a fluid inside it.

2. Description of the Related Art

A valve mechanism as described in Japanese Patent Laid-open No. 2001-179139 has a spherical valve body and a spring for giving momentum to the valve body toward a valve seat has been used. Manufacturing costs of the valve mechanism using the spherical valve body and the spring, however, tend to be high.

A valve mechanism having a resinous valve seat, and a resinous valve body which moves between a closed position in which the valve body contacts the valve seat and an open position in which the valve body separates from the valve seat is commonly used.

In the resinous valve mechanism, it is preferred that the valve mechanism has a simple configuration which can close a fluid flow reliably. Additionally, it is preferred that the configuration can alter a flow rate of the fluid passing through the valve mechanism discretionally according to a pressure applied to the fluid. As matters stand, however, a valve mechanism satisfying these requirements is not reported.

On the other hand, regarding the above type of tubular container, replacing conventional tubes comprising a metal or an aluminum-foil-laminated material, tubes comprising a synthetic resin alone or a lamination of a synthetic resin and aluminum (In this specification, these are named generically as "synthetic-resin-made".) have been used.

In the case of a tube-type container using a synthetic-resin-made tube, because these synthetic-resin-made tubes have an elasticity recovering force, the following problem occurs: When a pressure is removed after a fluid is discharged by applying the pressure to the tube, the air flows back from an opening portion for discharging the fluid to the fluid storing portion by the elasticity recovering force of the tube, deteriorating the quality of the fluid stored in the fluid storing portion.

For this reason, a tube-type container, in which a tabular valve body is provided in an opening portion for discharging the fluid and the opening portion is closed by this valve body when the original shape of the tube is restored by its elasticity, has been proposed (e.g. in Japanese Patent Laid-open No. 1995-112749, Japanese Patent Laid-open No.1998-157751, Japanese Utility Model Laid-open No.1984-26748, etc.).

In a conventional tube-type container in which the above-mentioned tabular valve body is provided, if the tube recovers its original shape by its elasticity slowly, the valve body fails to close the opening portion of the tube-type container and the air may flow back to the fluid storing portion.

Additionally, the conventional tube-type container in which the above-mentioned tabular valve body is provided has a problem that its durability is low.

Regarding the tube-type container described in Japanese Patent Laid-open No. 1998-157751, as the content is discharged, a shape of the container is changed gradually. Consequently, as the content remaining in the tube-type container is reduced, a shape change of the container increases and it becomes harder to discharge the content from the tube-type container.

For this reason, as described in Japanese Patent Laid-open No. 2000-109103 incorporated, a pneumatically pushed-out tube-type container, which has a double construction dividing the inside of the container into a content chamber and an air chamber is proposed. In this container construction, the content chamber communicates with the outside at its discharge port of the container and the air chamber has a valve construction portion at its bottom, which shuts off the air chamber to prevent the air inside the air chamber from flowing outward when a pressure is applied to the container by pressing down the body portion of the container. Through the valve construction portion, the air chamber communicates with the outside.

The tube-type container described in Japanese Patent Laid-open No. 2000-109103, however, can be used only with high-viscosity contents, because it does not possess a valve mechanism at its discharge port. If a low-viscosity fluid is stored in this tube-type container, there is a problem that the air flows back into the container from the discharge port of the container, lowering the quality of the fluid stored in the container.

Additionally, for the tube-type container described in Japanese Patent Laid-open No. 2000-109103, a valve mechanism needs to be provided in the air chamber. The valve mechanism, however, is generally expensive and increases the manufacturing costs of the tube-type container which should be manufactured inexpensively because it is disposable under normal conditions.

Furthermore, the tube-type container described in Japanese Patent Laid-open No. 2000-109103 has a construction including an air chamber at its body portion of the tube-type container, and a valve construction portion needs to be provided in the body portion. It is difficult, however, to manufacture a tube-type container with a valve construction portion provided at its body portion. Additionally, there is a problem that welding cannot be done satisfactorily due to the valve construction portion when attempting welding the bottom portion of the tube-type container.

The present invention is achieved to solve the above-mentioned problems and aims to provide a tube-type fluid container which prevents the air from flowing back into the container from the discharge port of the container and which can discharge the content easily.

SUMMARY OF THE INVENTION

The present invention solves the above-mentioned problems. It aims to provide a valve mechanism which can close a fluid reliably while its configuration is simple and which can alter a flow rate of the fluid passing through the valve mechanism discretionally according to a pressure applied to the fluid.

The present invention includes, but is not limited to, the following embodiments. Solely for the sake of understanding some embodiments of the present invention easily, reference numerals used in the figures explained later are referred to. However, the present invention is not limited to the structures defined by these reference numerals, and any suitable combination of elements indicated by these reference numerals can be accomplished.

In an embodiment, a valve mechanism (e.g., 3, 10) adapted for a fluid-discharging port (e.g., 12, 441) of a tube-type fluid container may comprise: a valve seat portion (e.g., 40, 331) having an opening (e.g., 41, 326) through which a fluid flows; a valve portion (e.g., 20) comprising a valve body (e.g., 21) having a shape corresponding to the opening, and a shaft (e.g., 22) connected to the valve body and extending downward from the valve body; and a valve support portion (e.g., 30) comprising: (i) a bottom plate (e.g., 39, 332) to which a tip of the shaft is connected; (ii) an annular support (e.g., 31, 232) fixedly connected to the valve seat portion; and (iii) multiple connectors (e.g., 32, 236) connecting the bottom plate and the annular support, the connectors elastically urging the bottom plate downward to close the opening with the valve body and being bendable as the bottom plate moves upward and pushes the valve portion to open the opening. The bottom plate may be integrated with the shaft as shown in FIG. 2(A).

In an embodiment, the multiple connectors may be composed of three or more connectors.

In another embodiment, the multiple connectors may have flexions (e.g., 36, 237).

In the above, a convex portion (e.g., 42) facing toward the valve body may be formed in a portion in the opening, which convex portion contacts the valve body when the valve body closes the opening.

In another embodiment, a convex portion (e.g., 24) facing toward the opening may be formed in a portion in the valve body, which convex portion contacts the valve seat portion when the valve body closes the opening.

In an embodiment, the valve portion may comprise a guide portion (e.g., 323) disposed on the side opposite to the shaft, and the valve mechanism may comprise a supporting body (e.g., 340) comprising (a) an opening portion (e.g., 345) for discharging a fluid and (b) a guide material (e.g., 325) guiding the guide portion.

In the above, the guide material may comprise multiple ribs (e.g., 341) contacting the outer circumferential surface of said guide portion.

Further, the valve seat portion may contact both of the bottom surface (e.g., 324) and the end surface (e.g., 25) of the valve body in a position in which the valve body closes the opening.

In an embodiment, a tube-type fluid container may comprise a tubular container main unit (e.g., 1, 140), at one end of which a fluid-discharging port (e.g., 12, 441) is formed, and the valve mechanism (e.g., 3, 10) as described above.

In the above, the container main unit may comprise (A) an internal container (e.g., 442) storing a fluid, and (B) an external container (e.g., 443) which is composed of a material having an elasticity recovering force and encompasses the internal container in such a way that an interior space (e.g., 444) shut off from the outside is formed between the external container and the internal container, and in which a hole (e.g., 149) communicating with the interior space and the outside is formed.

Further, the hole formed in the external container may have a size which can let a small amount of air through.

Furthermore, the hole formed in the external container may be formed in a portion to which a pressure is applied when the fluid is discharged.

In addition, opening portions (e.g., 148) of the internal container and of the external container may be connected to each other at the fluid-discharging port, and the internal container and the external container are welded at their bottoms (e.g., 147).

In an embodiment, a tube-type fluid container may comprise a tubular container main unit (e.g., 140), at one end of which a fluid-discharging port (e.g., 441) is formed, and a valve mechanism (e.g., 3, 10) disposed at the fluid-discharging port, wherein the container main unit comprises (A) an internal container (e.g., 442) storing a fluid, and (B) an external container (e.g., 443) which is composed of a material having an elasticity recovering force and encompasses the internal container in such a way that an interior space (e.g., 444) shut off from the outside is formed between the external container and the internal container, and in which a hole (e.g., 149) communicating with the interior space and the outside is formed.

In the above, the fluid can be discharged from an outlet of the mouth portion of the container through the valve mechanism by pressing the container, wherein the connectors and the container are deformed. When releasing the pressure, both the deformed connectors and the deformed container begin restoring the shapes. The restoring force of the container causes the inner pressure to lower, thereby generating reverse flow which facilitates restoration of the connectors to close the opening of the valve seat portion, thereby effectively preventing air from coming into the container through the outlet of the mouth portion. Thus, even if the restoring force of the connectors themselves is not sufficient to close the opening of the valve seat portion, the outlet of the mouth portion can effectively be closed in combination with the restoring force of the container. Thus, even if the fluid is very viscous, the valve mechanism in combination with the container can discharge the fluid and then seal the container.

In an embodiment, a valve (e.g., 3, 10) may comprise: a seat (e.g., 40, 331) having an opening (e.g., 41, 326) through which a fluid may flow; a seal (e.g., 20) comprising a body (e.g., 21) having a shape corresponding to the opening; and a support (e.g., 30) for coupling the seal to the seat, the support comprising multiple elastically deformable connectors (e.g., 32, 236), the connectors producing a biasing force that causes the seal to substantially close the opening; wherein the connectors are adapted to elastically deform in response to a fluid pressure on the seal that overcomes the biasing force so as to permit the flow of fluid through the opening.

In the above, the opening may comprise a first ledge (e.g., 45), the seat may comprise a second ledge (e.g., 23), the second ledge may sit on the first ledge when the opening is closed by the biasing force.

Further, at least one of the first ledge and the second ledge may comprise at least one tab (e.g., 24, 42).

In the above, in the event that the restoring force of the container is excessive (depending on the viscosity of the fluid and the amount of the fluid remaining in the container, etc., in addition to the elasticity characteristics of the container itself), the reverse flow is strong and fast, and the connectors may not be restored so quickly that it is difficult to prevent air from coming into the container from the outlet of the mouth portion through the opening of the valve seat portion. In that case, by using a double wall container, the restoring force can be controlled so that intensity of the reverse flow can be controlled to prevent air from coming into the container.

That is, when configuring the container body to be a double wall container, despite its simple configuration, reverse flow of air from the discharge port (or the mouth) of the container into the container can be prevented and the content can be discharged easily even when an amount of the content is reduced. When forming the through-hole in the outer container in a size which can let a small amount of air through, an amount of air outflow from the inner container to the outside can be controlled to be small, enabling to apply appropriate pressure to the fluid inside the inner container because certain pressure between the inner container and the outer container can be maintained when the outer container is pressed. When forming the through-hole in a portion to which a pressure is applied when the fluid is discharged, an amount of air outflow from the inner container to the outside can be controlled to be small when the outer container is pressed, enabling to apply an appropriate pressure to the fluid inside the inner container. When integrating the inner container and the outer container at the mouth portion and welding them at their bottom, manufacturing a tube-type fluid container at low costs becomes possible.

Additionally, in a double wall container, restoring force of an inner container may be lower than that of a single wall container, and thus, after connectors are at a closed position, the pressure inside the inner container may remain moderately lower than the ambient pressure, so that suction force at the outlet may not be significant. In that case, it is possible to effectively prevent air from coming into the container. Further, in a double wall container, an outer container can be restored more than an inner container, and an air layer is formed between the inner container and the outer container. When restricting the flow of air released from the air layer through a through-hole or though-holes, it is possible to exert pressure on the inner container from the outer container via the air layer. Thus, even if the amount of the fluid contained in the inner container is low and thus, the inner container is nearly flat, by pressing the outer container which has been restored to the original shape, it is possible to exert pressure onto the inner container, thereby easily discharging the fluid. Accordingly, waste of the fluid remaining inside the inner container can be minimized.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

Figure 1:
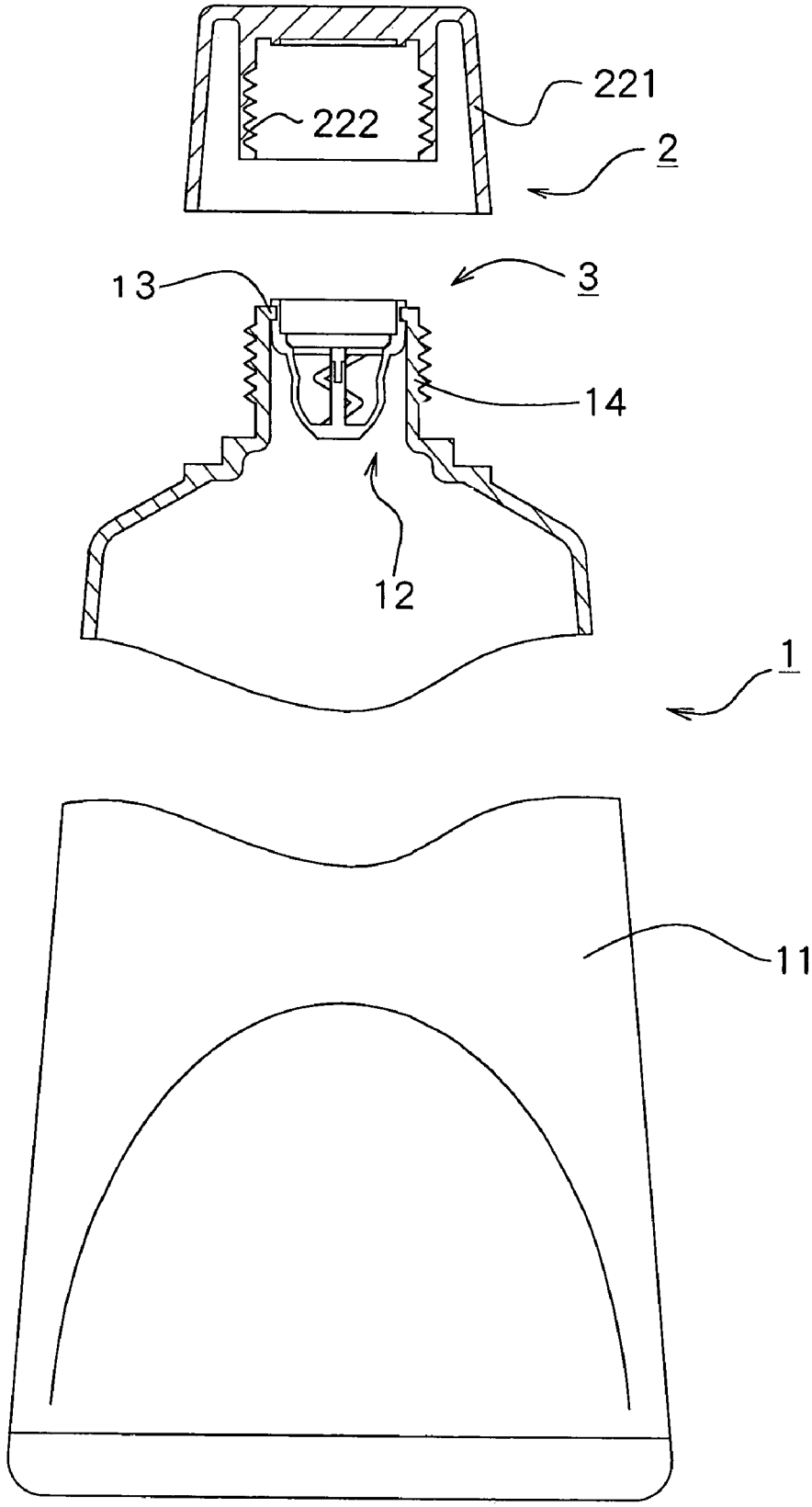
FIG. 1 is an exploded longitudinal section of the tube-type fluid container according to the Embodiment 1 of the present invention.

Explanation of symbols used is as follows: 1: Container main unit; 2: Lid material; 3: Valve mechanism; 4: Lid material; 5: Lid material; 10: Valve mechanism; 11: Fluid storing portion; 12: Discharge port; 13: Flange portion; 14: Male screw portion; 20: Valve material; 20': Valve material; 21: Valve body; 22: Engaging portion; 23: Inclined plane; 24: Convex portion; 25: End surface; 26: Groove portion; 27: O-ring; 30: Coupling material; 31: Valve seat material supporting portion; 32: Coupling portion; 33: Valve material supporting portion; 35: Engaging groove; 36: Flexions; 37: Concave portion; 38: Groove portion; 39: Bottom plate; 40: Valve seat material; 41: Opening portion; 42: Convex portion; 43: Engaging portion; 44: Convex portion; 45: Inclined plane; 51: Base portion; 52: Upper lid; 53: Female screw portion; 54: Discharge port; 110: Lid material; 111: Lid body; 115: Female screw portion; 140: Container main unit; 141: Opening portion; 142: Fluid storing portion; 143: Flange portion; 144: Male screw portion; 145: Internal container opening portion; 146: External container opening portion; 147: Welding portion on the bottom side; 148: Welding portion on the discharge port side; 149: Hole; 150: Flange portion; 151: Male screw portion; 221: Outer lid portion; 222: Female screw portion; 231: Opening portion; 232: Supporting portion; 233: Valve portion; 234: First connection portion; 235: Second connection portion; 236: Coupling portion; 237: Flexions; 238: groove portion; 241: Discharge port; 242: Female screw portion; 323: Guide portion; 324: Under surface; 325: Guide material; 326: Opening; 327: Reinforcing ring; 330: Valve seat material; 330': Valve seat material; 331: Valve seat portion; 332: Valve material supporting portion; 333: Coupling portion; 334: Level surface; 335: Vertical surface; 337: Convex portion; 338: Opening portion; 339: Groove portion; 340: Supporting body; 341: Rib; 342: Guide path; 343: Female screw portion; 344: Concave portion; 345: Opening portion; 415: Female screw portion; 441: Discharge port; 442: Internal container; 443: External container; 444: Internal space.

DETAILED DESCRIPTION OF THE PREFERRED EMBODIMENT

Preferred embodiments of the present invention will be described with referent to the drawings. The present invention is not limited to the embodiments.

A first example is a tube-type fluid container having a tubular container main unit at one end of which a fluid discharge port is formed and a valve mechanism set up at said discharge port, which is characterized in that said valve mechanism possesses a supporting portion at the center of which an opening portion constituting a valve seat is formed and which has a nearly tubular shape installable at said discharge port; a valve portion which can contact an area in which said opening portion in said supporting portion is formed from the opposite side to said container main unit; a connection portion set up by standing it in said valve portion on the side of said container main unit; multiple coupling portions for giving momentum to said valve portion toward said opening portion by coupling said supporting portion and said connection portion with an elastic force.

A second example is the tube-type fluid container as described in the first example, wherein said supporting portion and said valve portion in said valve mechanism are coupled by three or more coupling portions set up at even intervals.

A third example is the tube-type fluid container as described in the second example 2, wherein said coupling portions in said valve mechanism have flexions.

A fourth example is a valve mechanism which possesses a valve material having a valve seat material in which a circular opening portion functioning as a valve seat is formed, a valve body having a shape corresponding to said circular opening portion and an engaging portion set up by standing it, and a coupling material having a valve seat material supporting portion which supports said valve seat material, a valve material supporting portion which supports the engaging portion of said valve material, and multiple coupling portion having flexibility which couple said valve seat material supporting portion and said valve material supporting portion; which is characterized in that by the flexibility of said multiple coupling portions, said valve material is constructed to move between a closed position in which the valve body in the valve material closes the opening portion in said valve seat material and an open position in which the valve body opens said opening portion.

A fifth example is the valve mechanism as described in the fourth example, wherein said coupling material has three or more coupling portions.

A sixth example is the valve mechanism as described in the fourth or fifth example, wherein said coupling portions have flexions.

A seventh example is the valve mechanism as described in any one of the fourth to sixth examples, wherein a ring-shaped convex portion facing toward said valve body is formed in a portion in said opening portion, which contacts said valve body.

An eighth example is the valve mechanism as described in any one of the fourth to sixth examples, wherein a ring-shaped convex portion facing toward said opening portion is formed in a portion in said valve body, which contacts said opening portion.

A ninth example is a valve mechanism which possesses a valve material possessing a valve body, an engaging portion set up by standing it in the valve body and a guide portion set up by standing it on the side opposite to said engaging portion in the valve body, a valve seat material possessing a valve seat portion which has a circular opening portion functioning as a valve seat for said valve body, a valve material supporting portion which engages with said engaging portion and multiple coupling portions having flexibility which couple said valve seat portion and said valve material supporting portion, and a supporting body possessing an opening portion for discharging a fluid and a guide material guiding said guide portion; which is characterized in that said valve material is constructed to be able to move between a closed position in which said valve body in the valve material closes the opening portion in said valve seat material and an open position in which said valve body opens said opening portion by the flexibility of said multiple coupling portions.

A tenth example is the valve mechanism as described in the ninth example, wherein said guide material comprises multiple ribs contacting the outer circumferential surface of said guide portion.

An eleventh example is the valve mechanism as described in the ninth or tenth example, wherein said valve seat portion contacts the bottom surface and the end surface of said valve body in a position in which said valve material is positioned in said closed position.

A twelfth example is the valve mechanism as described in any one of the ninth to eleventh examples, wherein said valve seat material has three or more coupling portions.

A thirteenth example is the valve mechanism as described in any one of the ninth to twelfth examples, wherein said coupling portions have flexions.

A fourteenth example is a tube-type fluid container having a tubular container main unit, at one end of which a fluid discharge port is formed, and a valve mechanism set up at said discharge port, which is characterized in that said container main unit possesses an internal container storing a fluid, an external container which comprises a material having an elasticity recovering force and encompasses said internal container in such a way that an interior space shut off from the outside is formed between the external container and internal container, and in which a hole communicating with said interior space and the outside is formed.

A fifteenth example is the tube-type fluid container as described in the fourteenth example, wherein the hole formed in said external container has a size which can let a small amount of air through.

A sixteenth example is the tube-type fluid container as described in the fourteenth example, wherein the hole formed in said external container is formed in a portion to which a pressure is applied when the fluid is discharged.

A seventeenth example is the tube-type fluid container as described in any one of the fourteenth to sixteenth examples, wherein the opening portions of said internal container and of said external container are connected each other at the discharge port portion of said container main unit, and said internal container and said external container are welded at their bottoms.

FIG. 1 is an exploded longitudinal section of the tube-type fluid container according to the Embodiment 1 of the present invention; FIG. 2 is a longitudinal section of the relevant part of the tube-type fluid container according to the Embodiment 1 of the present invention.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc. In this specification, regular liquids, high-viscosity liquids, semifluids, or gels that sol solidifies to a jelly, and creams are all referred to as fluids.

This tube-type fluid container comprises a container main unit 1, a lid material 2 and a valve mechanism 3.

The above-mentioned container main unit 1 possesses a tubular fluid storing portion 11 for storing a fluid inside it, a fluid discharge port 12 formed at one end of the fluid storing portion 11, a flange portion 13 formed in the vicinity of the upper end of the discharge port 12, and a male screw portion 14 formed on the outside of the discharge port 11. This container main unit 1 comprises a synthetic resin alone or a lamination of a synthetic resin and aluminum and has an elasticity recovering force which tries to recover its original shape when a pressure applied to it is removed.

The above-mentioned lid material 2 has an outer lid portion 221 and a female screw portion 222 formed inside the lid material 2. This tube-type fluid container is constructed such a way that the discharge port 12 of the container main unit 1 is closed with the female screw portion 222 engaging with the male screw portion 14 in the container main unit 1.

Figure 3:
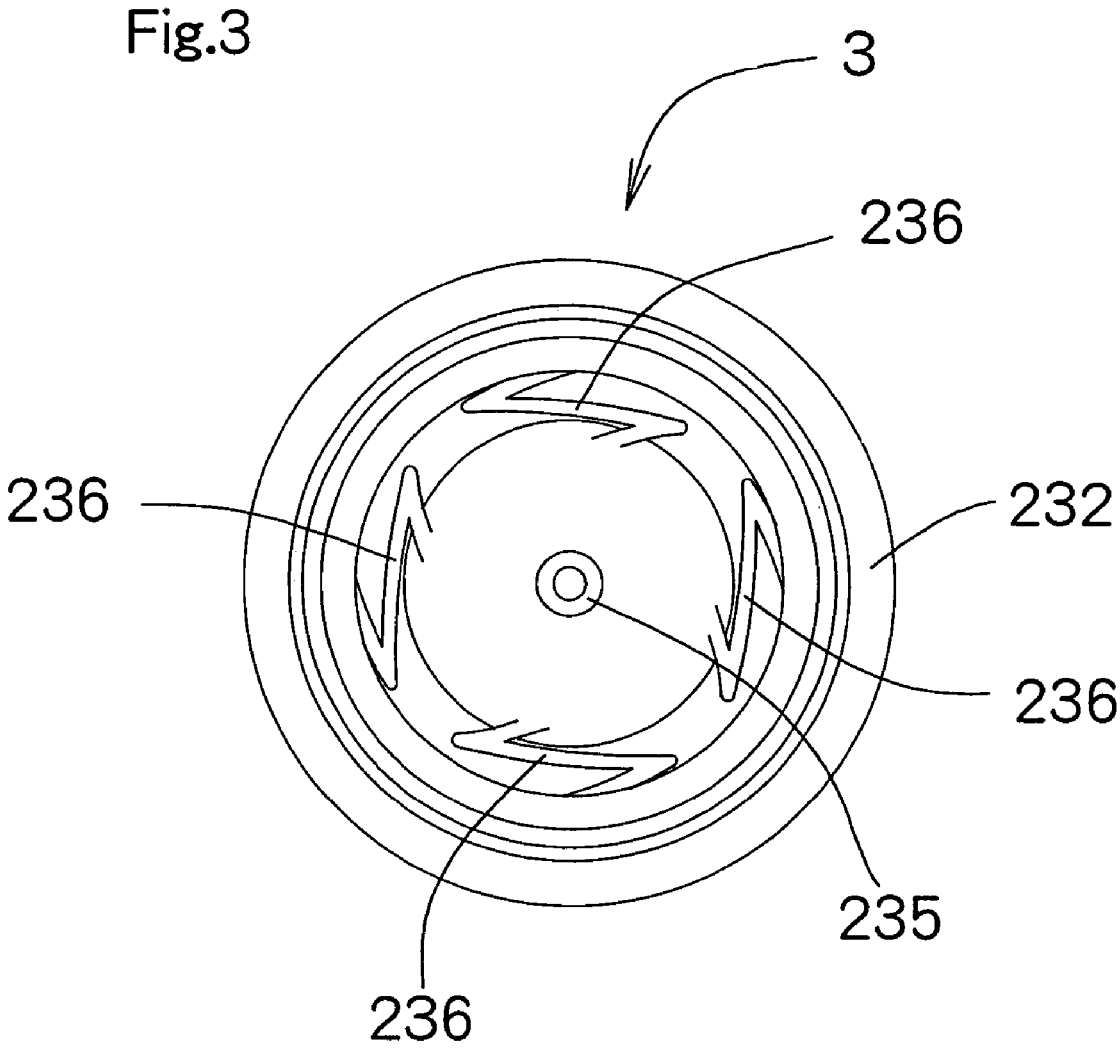
FIG. 3 is a plan view of the valve mechanism 3.
Figure 4:
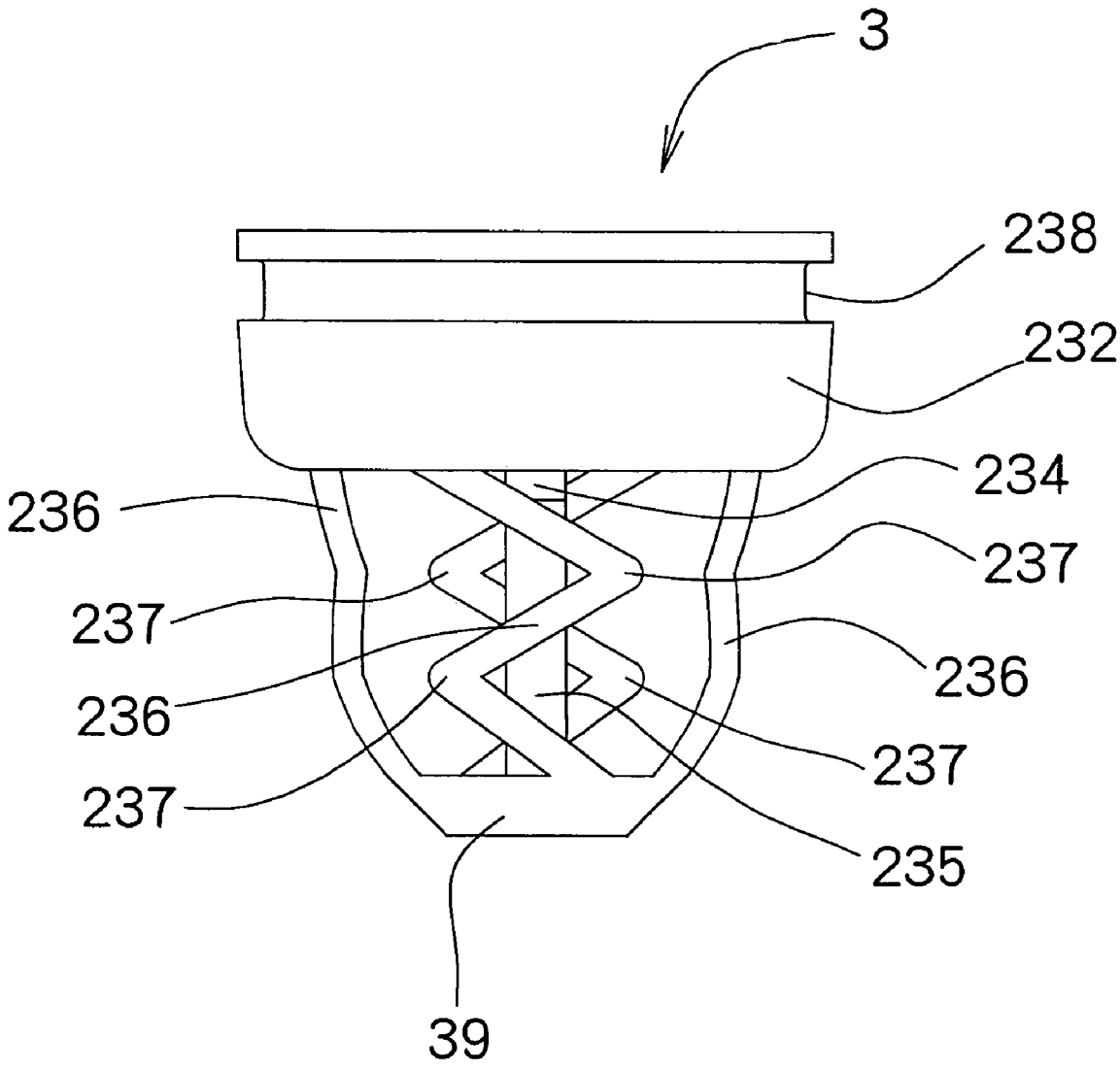
FIG. 4 is a lateral view of the valve mechanism 3.

A construction of the above-mentioned valve mechanism 3 is described below. FIG. 3 is a plan view of the valve mechanism 3; FIG. 4 is a lateral view of the valve mechanism 3. In FIG. 3, a valve portion 233 and the first connection portion 234 are not included.

In reference to FIG. 2 to FIG. 4, this valve mechanism 3 possesses a supporting portion 232 having a nearly tubular shape, at the center of which an opening portion 231 (See FIG. 2.) constituting a valve portion is formed, the valve portion 233 which can contact an area in which the opening portion 231 in the supporting portion 232 is formed from the opposite side to the container main unit 1, the first connection portion 234 set up by standing it in the valve portion on the side of the container main unit 1, the second connection portion 235 having a nearly T-shaped section, which is coupled with the first connecting portion, and four coupling portions 236 for giving momentum to the valve portion 233 toward the opening portion 231 constituting a valve seat by coupling the supporting portion 232 and the second connection portion 235 with an elastic force.

The four coupling portions 236 are set up at even intervals. Additionally, these coupling portions 236 respectively have flexions 237 in two places.

On the outer circumferential surface of the supporting portion 232, a groove portion 238 (See FIG. 4.) which can engage with the flange portion 13 in the container main unit 1 is formed. Consequently, the valve mechanism 3 is installed at the discharge port 12 in the container main unit 1 using this groove portion 238 as shown in FIG. 4.

Additionally, the above-mentioned supporting portion 232, the first and the second connection portions 234 and 235 and the coupling portions 236 are produced by injection molding using synthetic resin such as polyethylene and polypropylene, synthetic rubber such as silicon rubber or a mixture of these materials. The supporting portion 232, the coupling portions 236 and the second connection portion 235, and the valve portion 233 and the first connection portion 234 are respectively molded separately and are coupled with each other.

In the tube-type container having the above-mentioned construction, when a fluid is discharged from inside the container main unit 1, a pressure is applied to the fluid inside the fluid storing portion 11 by pressing the fluid storing portion 11. As shown in FIG. 2 (B), being pressurized by the fluid and resisting the elasticity of the coupling portions 236, the valve portion 233 separates from the supporting portion 232 in which the opening portion 231 constituting the valve seat is formed; the fluid inside the fluid storing portion 11 is discharged outward after passing through the opening portion 231.

When the pressure applied to the fluid storing portion 11 is removed after a necessary amount of fluid is discharged, the fluid inside the fluid storing portion 11 is depressurized by the elasticity recovering force of the container main unit 1; the air tries to flow back toward the fluid storing portion 11 from the opening portion 231.

Figure 2A:
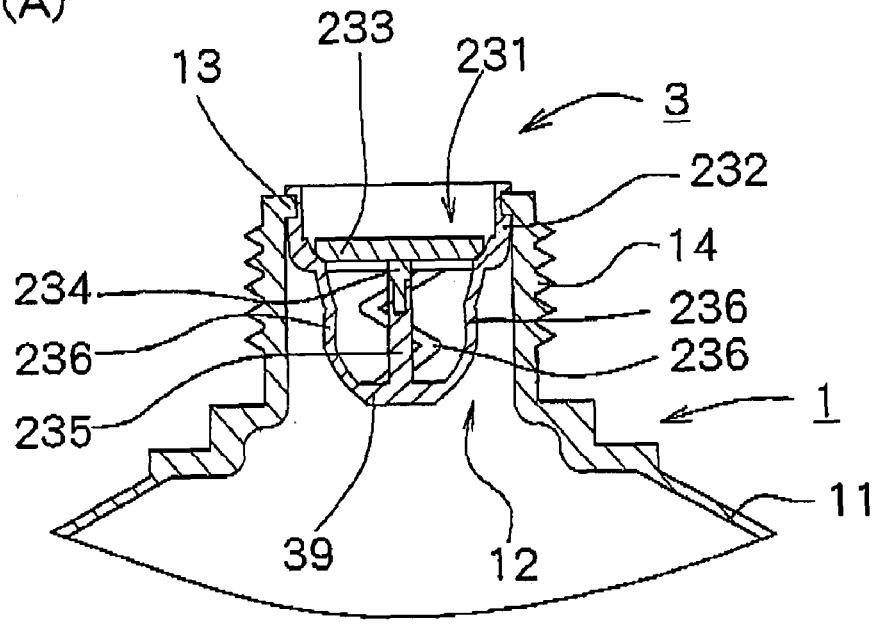
FIGS. 2(A) and 2(B) are longitudinal sections of the relevant part of the tube-type fluid container according to the Embodiment 1 of the present invention.
Figure 2B:
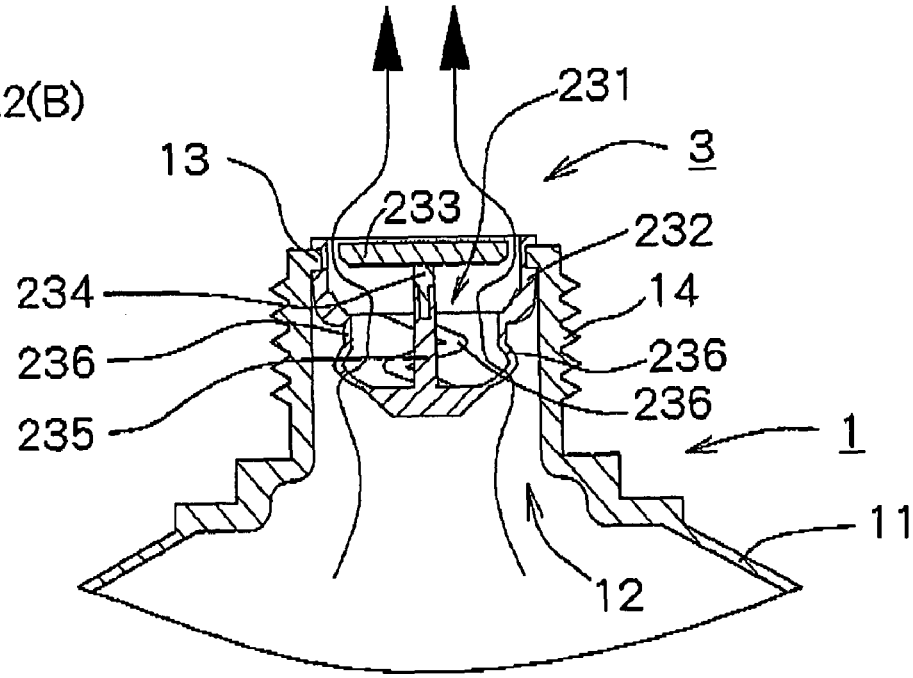

In this tube-type container, however, as soon as the fluid inside the fluid storing portion 11 is depressurized, the valve portion 233 instantaneously contacts the supporting portion 232 in which the opening portion 231 constituting the valve seat is formed by the action of the coupling portions 236 as shown in FIG. 2(A); the opening portion 231 comprising a fluid flow path is closed. Consequently, the reverse flow of the air can be prevented effectively.

At this time, in the valve mechanism 3 according to this embodiment, as a travel distance of the valve body 233 is changed according to a pressure applied to the fluid storing portion 11, i.e. a pressure applied to the valve mechanism 3, it becomes possible to change a flow rate of the fluid passing through the opening portion 231. Consequently, when a regular liquid is used as a fluid, discharging the liquid by a specific amount also becomes possible by applying a small pressure to the liquid inside the fluid storing portion 11.

In the valve mechanism 3 according to this embodiment, the top surface of the valve portion 233 in the valve mechanism 3 is set up at a position close to the top surface of the flange portion 13 in the container main unit 1. Consequently, it becomes possible to minimize an amount of the fluid remaining inside the opening portion 231 in the container main unit 1 after fluid discharge motions are completed.

Furthermore, in this valve mechanism 3, four coupling portions 236, which couple the supporting portion 232 and the valve body 233, respectively have a pair of flexions 237. Consequently, these coupling portions 236 have adequate elasticity; it becomes possible for the valve body 233 to reciprocate smoothly between the closed position and the open position.

Figure 5:
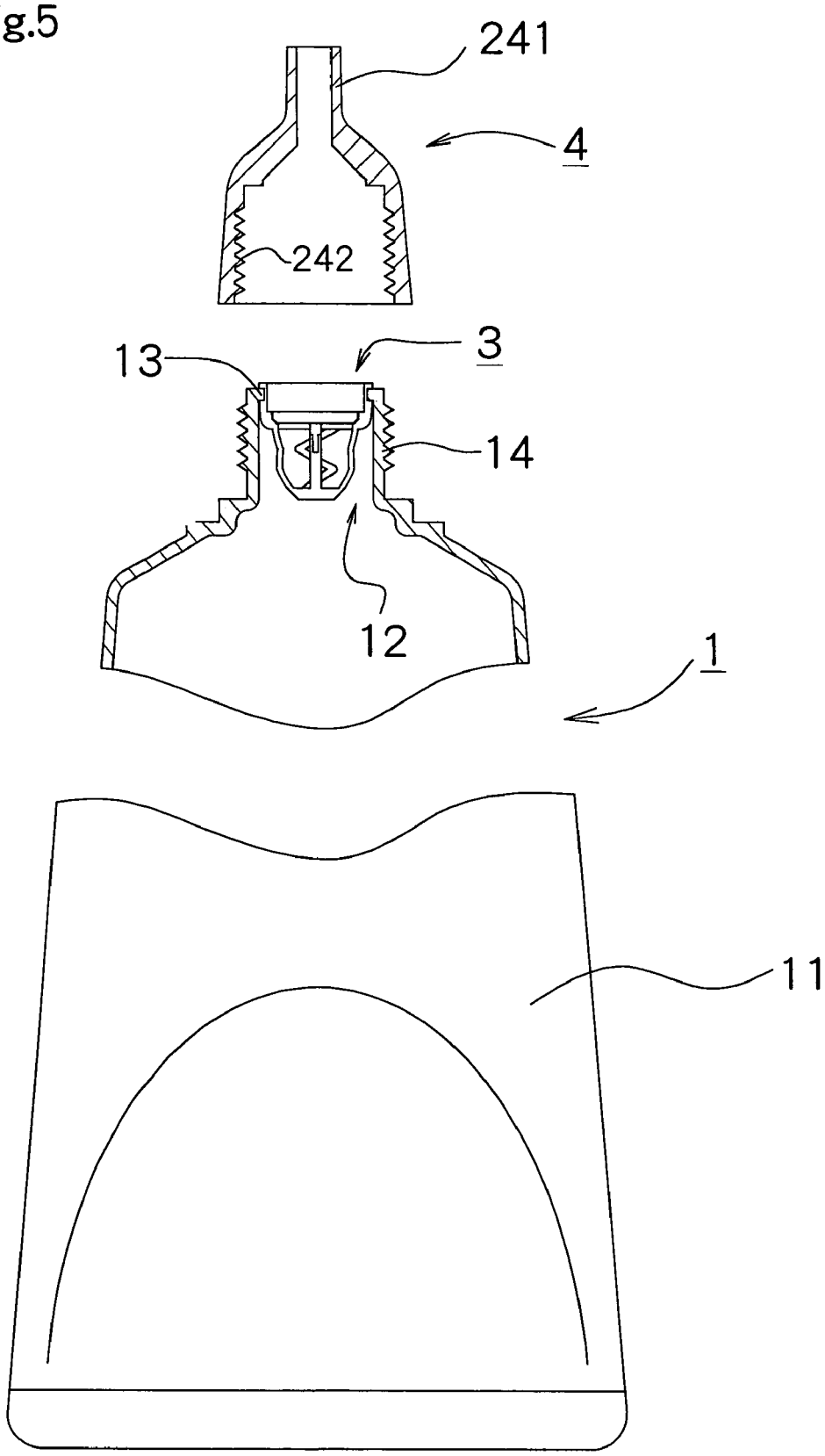
FIG. 5 is an exploded longitudinal section of the tube-type fluid container according to the Embodiment 2 of the present invention.

A construction of a tube-type fluid container according to another embodiment of the present invention is described below. FIG. 5 is an exploded longitudinal section of the tube-type fluid container according to the Embodiment 2.

In the above-mentioned tube-type container according to the Embodiment 1, the lid material 2 having a construction in which with the female screw portion 222 of the lid material screwing together with the male screw portion 14 in the container main unit, the discharge port 12 of the container main unit 1 is closed, is used. In this Embodiment 2, a lid material 4 having a fluid discharge port 241 at its end is used. The fluid container according to the Embodiment 2 has a construction in which a discharge port 12 of the container main unit 1 and the discharge port 241 of the lid material 4 are communicated with the female screw portion 242 of the fluid container screwing together with the male screw portion 14 of the container main unit 1.

Figure 6:
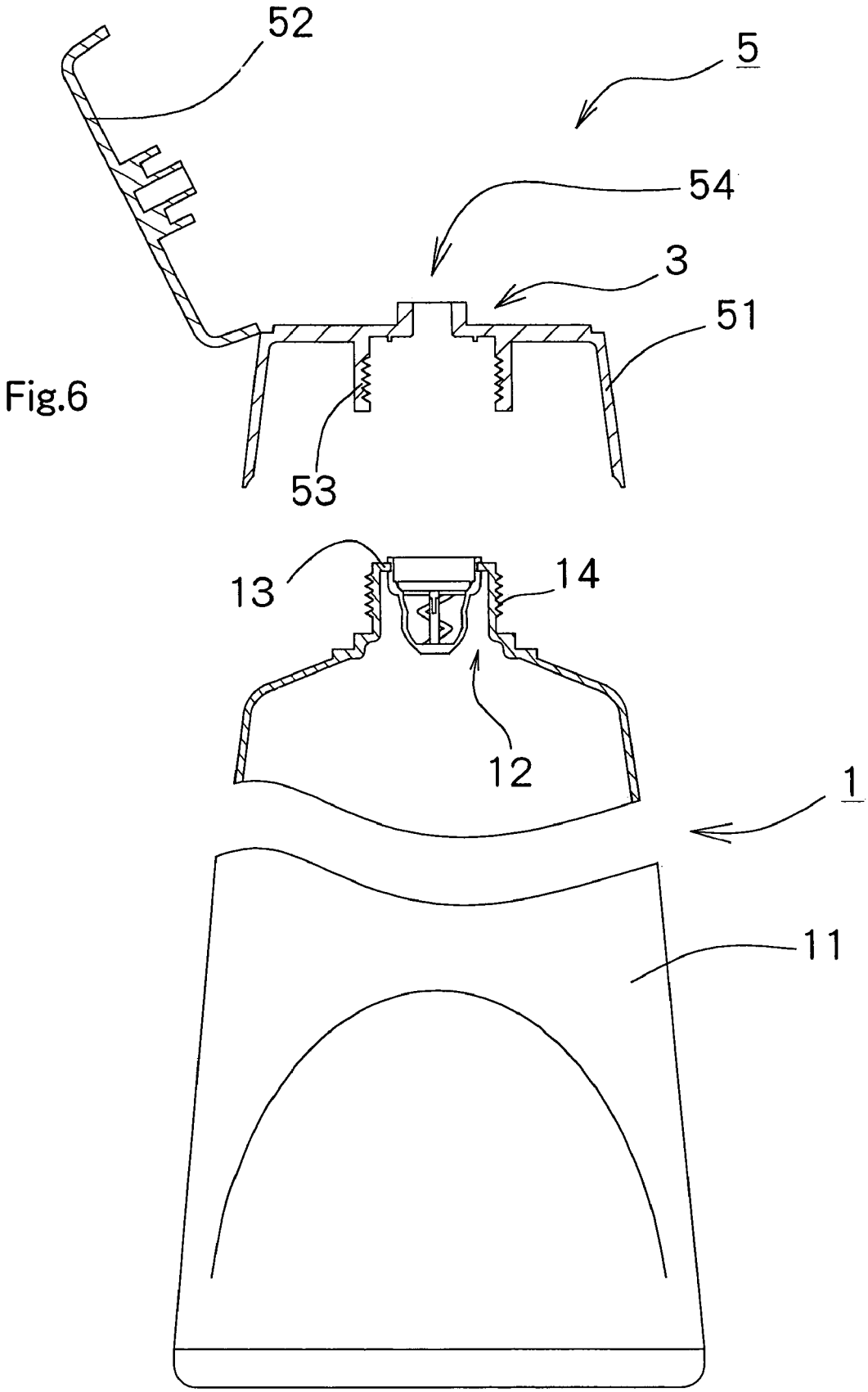
FIG. 6 is an exploded longitudinal section of the tube-type fluid container according to the Embodiment 3 of the present invention.

A construction of the tube-type fluid container according to the third aspect of the present invention is described below. FIG. 6 is an exploded longitudinal section of the tube-type fluid container according to the Embodiment 3 of the present invention.

In this tube-type fluid container according to the Embodiment 3, a lid material 5 comprising a base portion 51 possessing a fluid discharge port 53 at its center and an upper lid 52 which can hinge with the base portion 51 is used. This tube-type fluid container according to the Embodiment 3 has a construction in which a discharge port 12 of the container main unit 1 and the discharge port 54 of the lid material 5 are communicated with the female screw portion 53 of the fluid container screwing together with the male screw portion 14 of the container main unit 1. Additionally, in this tube-type fluid container according to the Embodiment 3, by causing the upper lid 52 to hinge with the base portion 51, it becomes possible to open/close the discharge port 54 of the lid material 5.

In any one of the above-mentioned embodiments, although the supporting portion 232 and the second connection portion 235 are coupled by four coupling portions 236 which are set up at even intervals, the number of coupling portions 236 is not limited to four. If the supporting portion 232 and the second connection portion 235 are coupled by three or more coupling portions which are set up at even intervals, it becomes possible to prevent occurrence of an inappropriate tilt in the valve portion 232.

In any one of the above-mentioned embodiments, the upper end of the supporting portion 232 in the valve mechanism 3 is set up at nearly the same position as the position of the upper end of the discharge port 12 in the container main unit 2, and an inside diameter of the opening portion 231 in the valve mechanism 3 is set to be nearly the same as an inside diameter of the discharge portion 12 in the container main unit 1. It is acceptable, however, that the supporting portion 232 has, for example, similarly to the shape of the lid material 4 shown in FIG. 5, a nozzle shape in which the opening portion of the supporting portion becomes smaller as it goes upward and the valve portion is contacted with the upper end of the nozzle-shaped opening portion having a smaller inside diameter.

According to the invention described in the first aspect, because the valve mechanism possesses the supporting portion at the center of which the opening portion constituting a valve seat is formed and which has a nearly tubular shape installable at the discharge port; the valve portion which can contact an area in which the opening portion in the supporting portion is formed from the opposite side to the container main unit; the connection portion set up by standing it in the valve portion on the side of the container main unit; multiple coupling portions for giving momentum to the valve portion toward the opening portion by coupling the supporting portion and the connection portion with an elastic force, it becomes possible to prevent the reverse flow of the air reliably while its construction is simple and excellent durability is provided as well.

According to the invention described in the second aspect, because the supporting portion and the valve portion in the valve mechanism are coupled by three or more coupling portions which are set up at even intervals, it becomes possible to prevent occurrence of an inappropriate tilt in the valve body.

According to the invention described in the third aspect, because the coupling portions in the valve mechanism have flexions, the coupling portions have more adequate elasticity recovering force, enabling the valve body to move between the closed position and the open position more satisfactorily.

Figure 7:
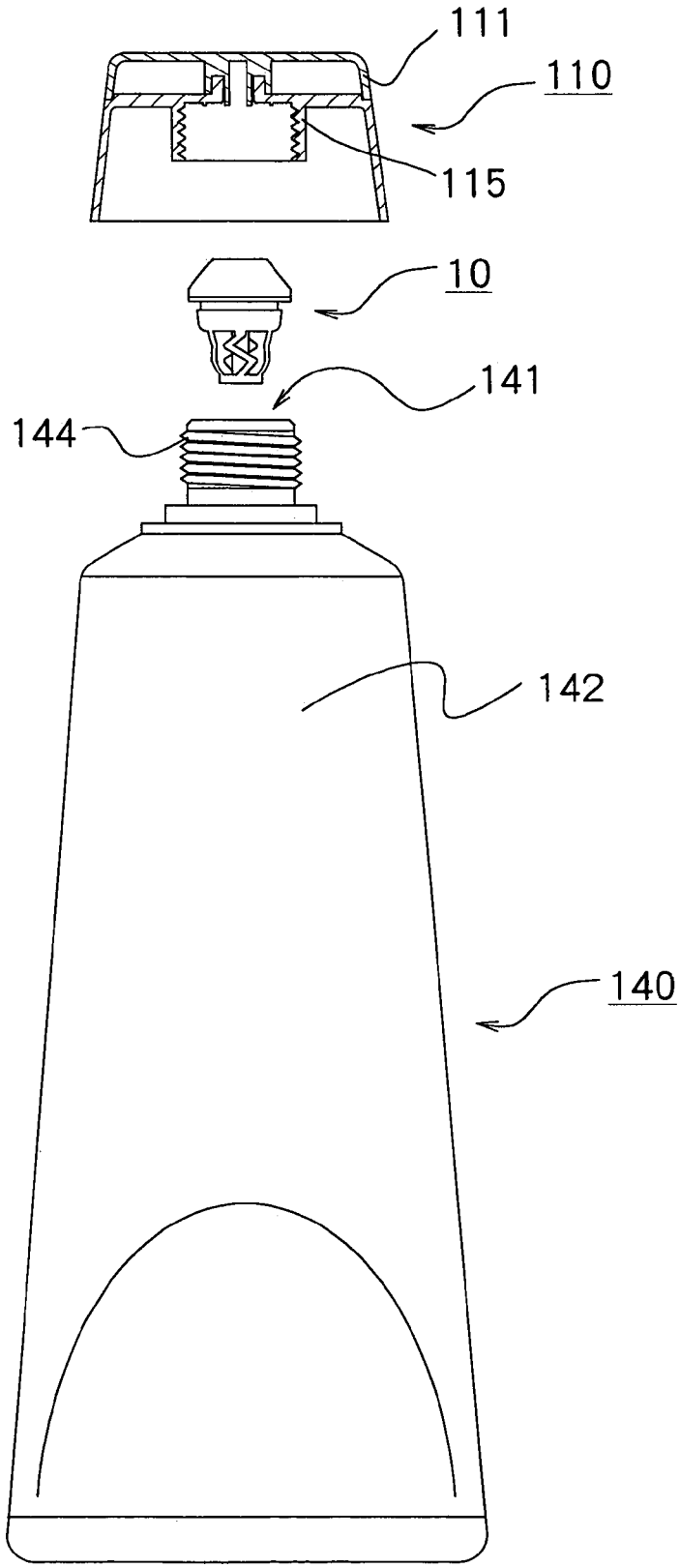
FIG. 7 is an exploded explanatory view of a tube-type container to which the valve mechanism according to the present invention applies.
Figure 8:
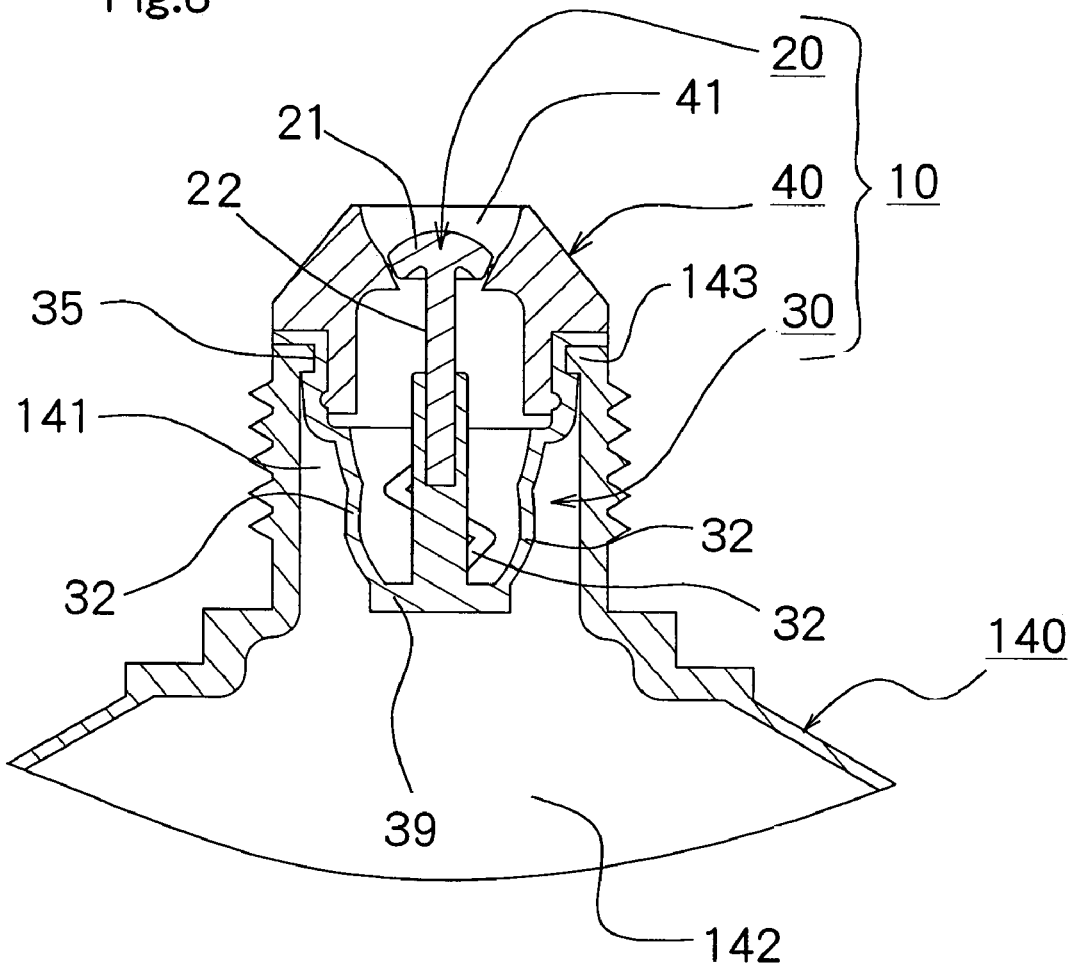
FIG. 8 is an enlarged view of the relevant part of the tube-type container to which the valve mechanism according to the present invention applies.
Figure 9:
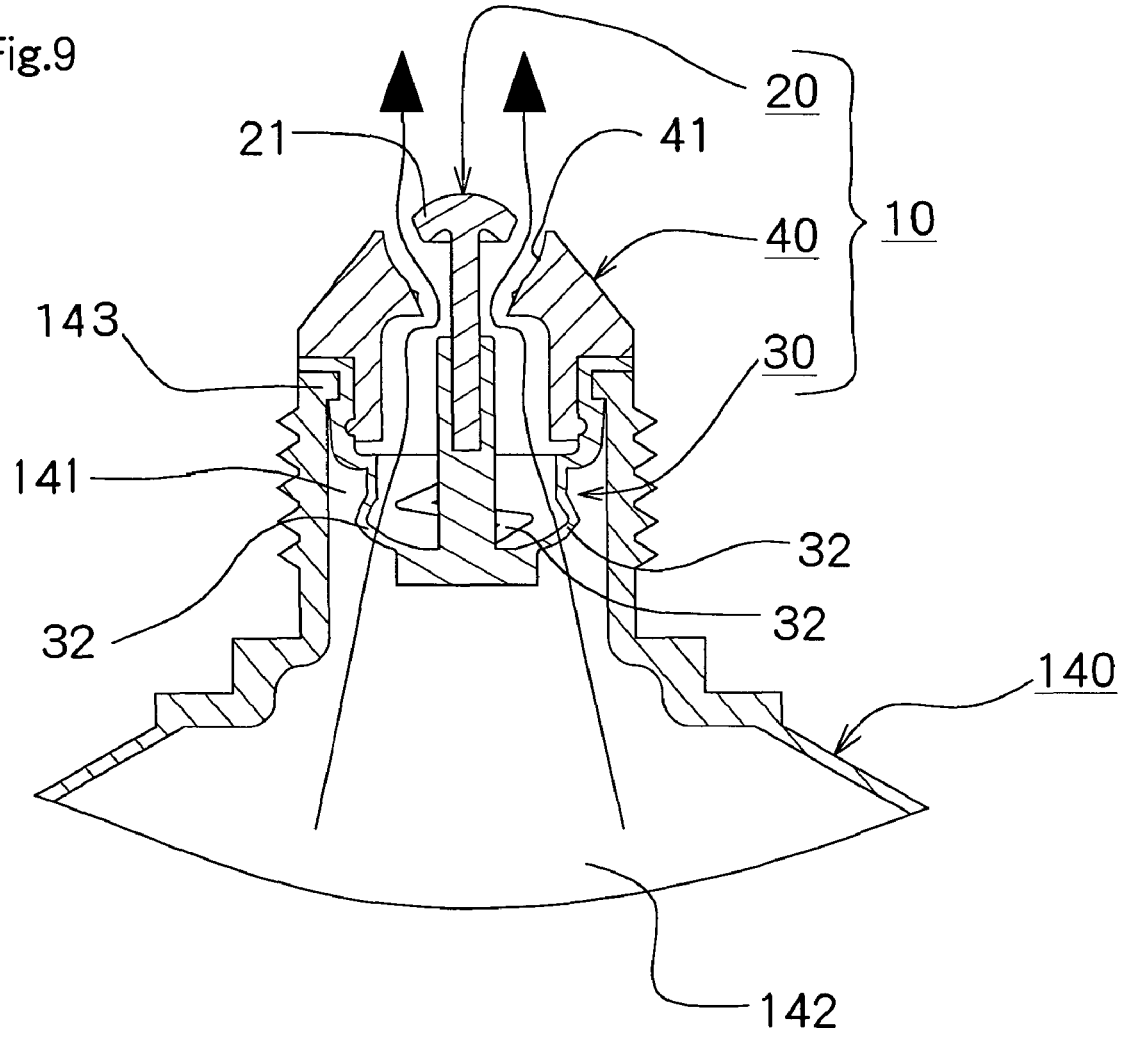
FIG. 9 is an enlarged view of the relevant part of the tube-type container to which the valve mechanism according to the present invention applies.

FIG. 7 is an exploded explanatory view of a tube-type container to which the valve mechanism according to the present invention applies. FIG. 8 and FIG. 9 are enlarged views of the relevant part of the tube-type container to which the valve mechanism according to the present invention applies.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

In this specification, regular liquids, high-viscosity liquids, semifluids, gels that sol solidifies to a jelly, and creams, are all referred to as fluids. The present invention, however, is not limited to a valve mechanism used for the above-mentioned fluids and can apply to a valve mechanism used for the entire fluids including gases.

This tube-type container possesses a container main unit 140, a lid material 110 which is installed at the top of the container main unit 140 and a valve mechanism 10.

The container main unit 140 comprises a fluid storing portion 142 for storing a fluid inside it, an opening portion 141 for discharging a fluid, which is formed at one end of the fluid storing portion 142, a flange portion 143 (See FIG. 8 and FIG. 9.) formed in the vicinity of the upper end of the opening portion 141, and a male screw portion 144 formed on the outside of the opening portion 141. The above-mentioned flange portion 143 is constructed to be able to engage with an engaging groove 35 in a coupling material 30 which is described later. Consequently, the valve mechanism 10 has a construction in which it is fixed inside the opening portion 141 in the container main unit 140 via this engaging groove 35.

This container main unit 140 comprises a synthetic resin alone or a lamination of a synthetic resin and aluminum, and has an elasticity recovering force which tries to recover its original shape when a pressure applied to it is removed.

The above-mentioned lid material 110 possesses a lid body 111 and a female screw portion 115 formed at the center of the lid body 111. The female screw portion 115 in the lid body 111 is constructed to screw together with the male screw portion 144 in the container main unit 140.

In the tube-type container having the above-mentioned construction, when a fluid is discharged from the container, a pressure is applied to the fluid inside the fluid storing portion 142 by pressing the fluid storing portion 142 in the container main unit 140. In this position, the valve mechanism 10 comprising the valve material 20, the coupling material 30 and the valve seat material 40 is opened and the fluid inside the fluid storing portion 142 is discharged outward via the opening portion 41 in the valve mechanism 10 as shown in FIG. 9.

When the pressure applied to the fluid storing portion 142 is removed after a necessary amount of the fluid is discharged, the fluid inside the fluid storing portion 142 is depressurized by the elasticity recovering force of the container main unit 140; the air tries to flow back toward the fluid storing portion 142 from the opening portion 141 for discharging the fluid.

In this tube-type container, however, a fluid flow path is closed by the action of the valve mechanism 10 comprising the valve material 20, the coupling material 30 and the valve seat material 40. Consequently, the reverse flow of the air can be prevented effectively.

A construction of the valve mechanism 10 according to the present invention is described below. The valve mechanism 10 comprises the valve material 20, the coupling material 30 and the valve seat material 40.

Figure 10:
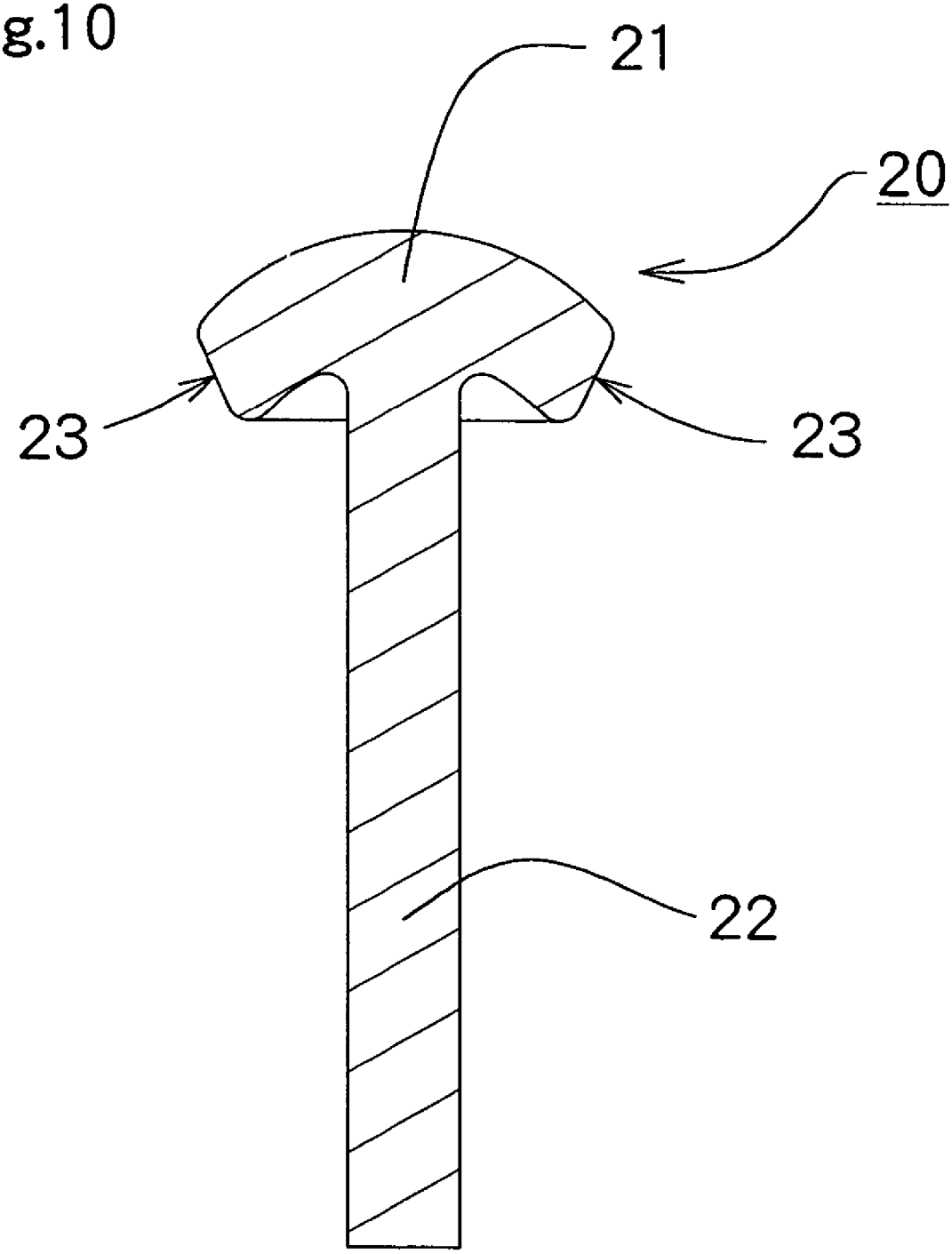
FIG. 10 is a longitudinal section of the valve material 20 constituting the valve mechanism 10 according to the present invention.
Figure 11:
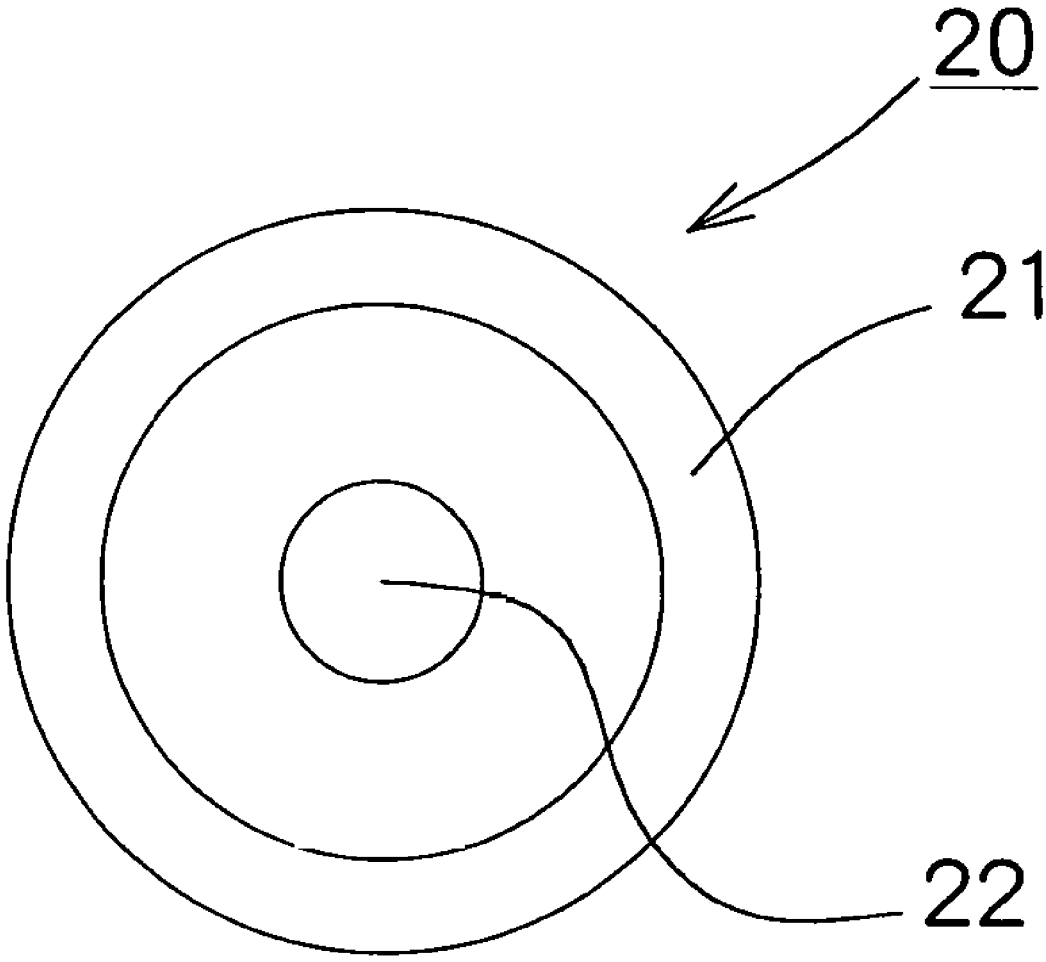
FIG. 11 is a bottom view of the valve material 20 constituting the valve mechanism 10 according to the present invention.

FIG. 10 is a longitudinal section of the valve material 20 constituting the valve mechanism 10 according to the present invention. FIG. 11 is a bottom view of the valve material 20 constituting the valve mechanism 10 according to the present invention.

As shown in FIG. 10 and FIG. 11, the valve material 20 has a valve body 21 having a shape corresponding to the circular opening portion 41 in the valve seat material 40 which is described later, and an engaging portion 22 set up by standing it.

Figure 12:
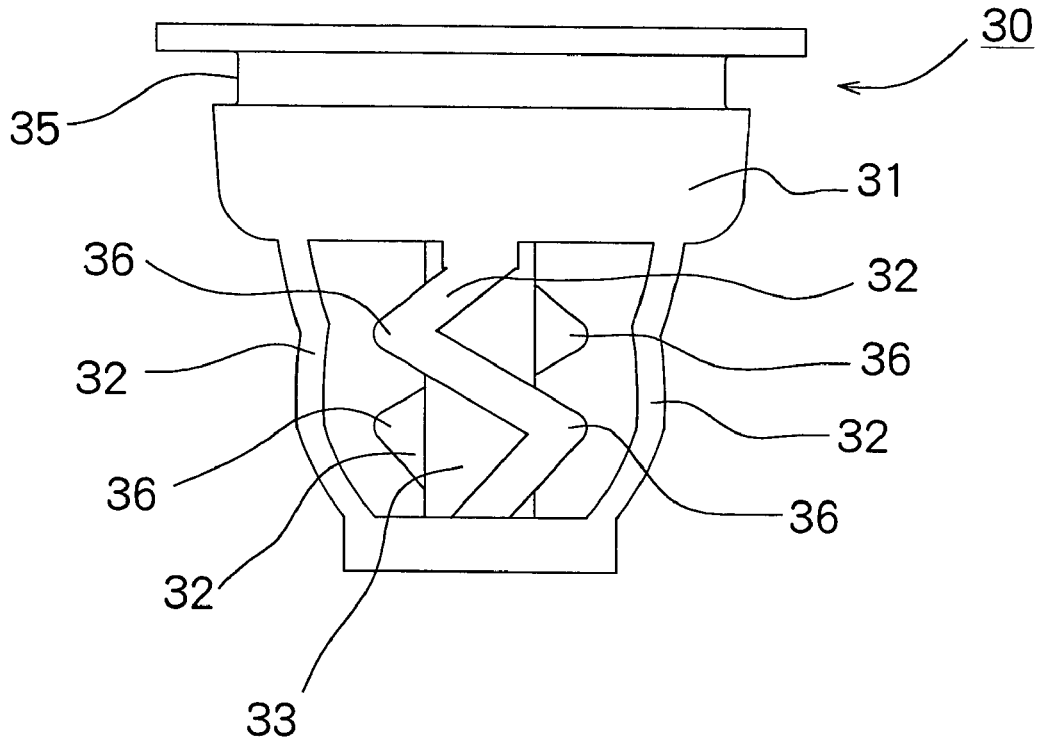
FIG. 12 is a lateral view of the coupling material 30 constituting the valve mechanism 10 according to the present invention.
Figure 13:
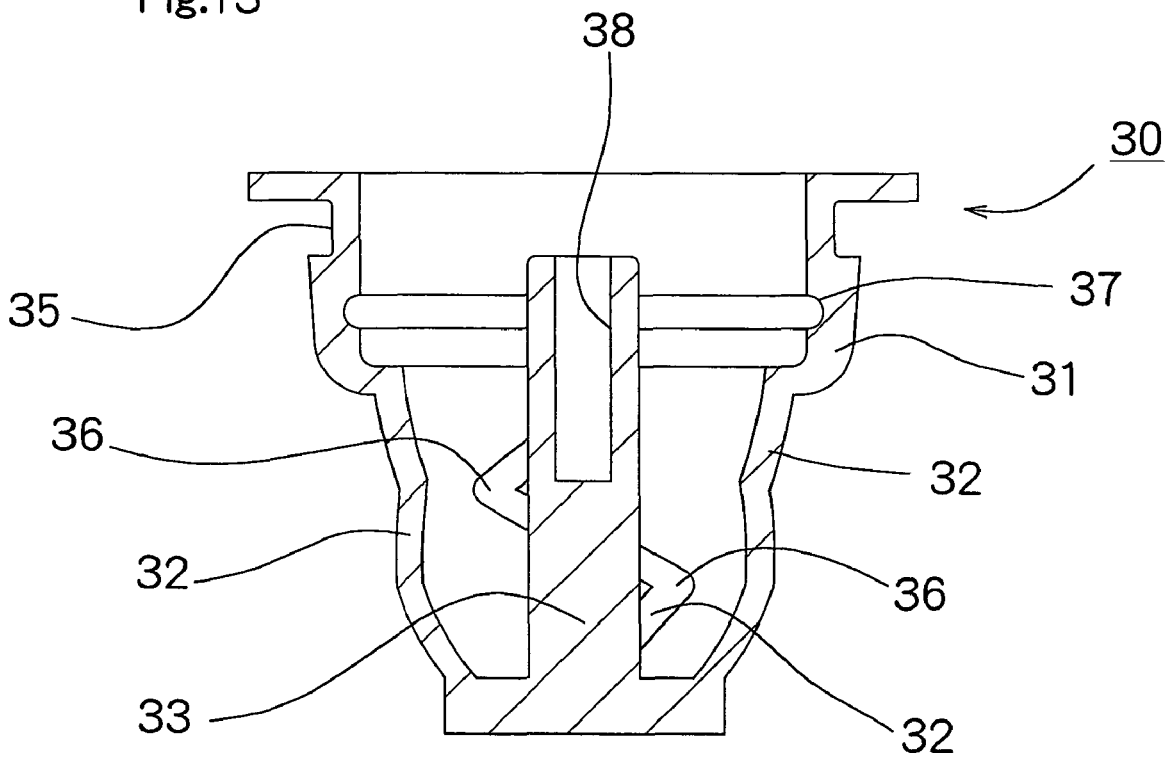
FIG. 13 is a longitudinal section of the coupling material 30 constituting the valve mechanism 10 according to the present invention.
Figure 14:
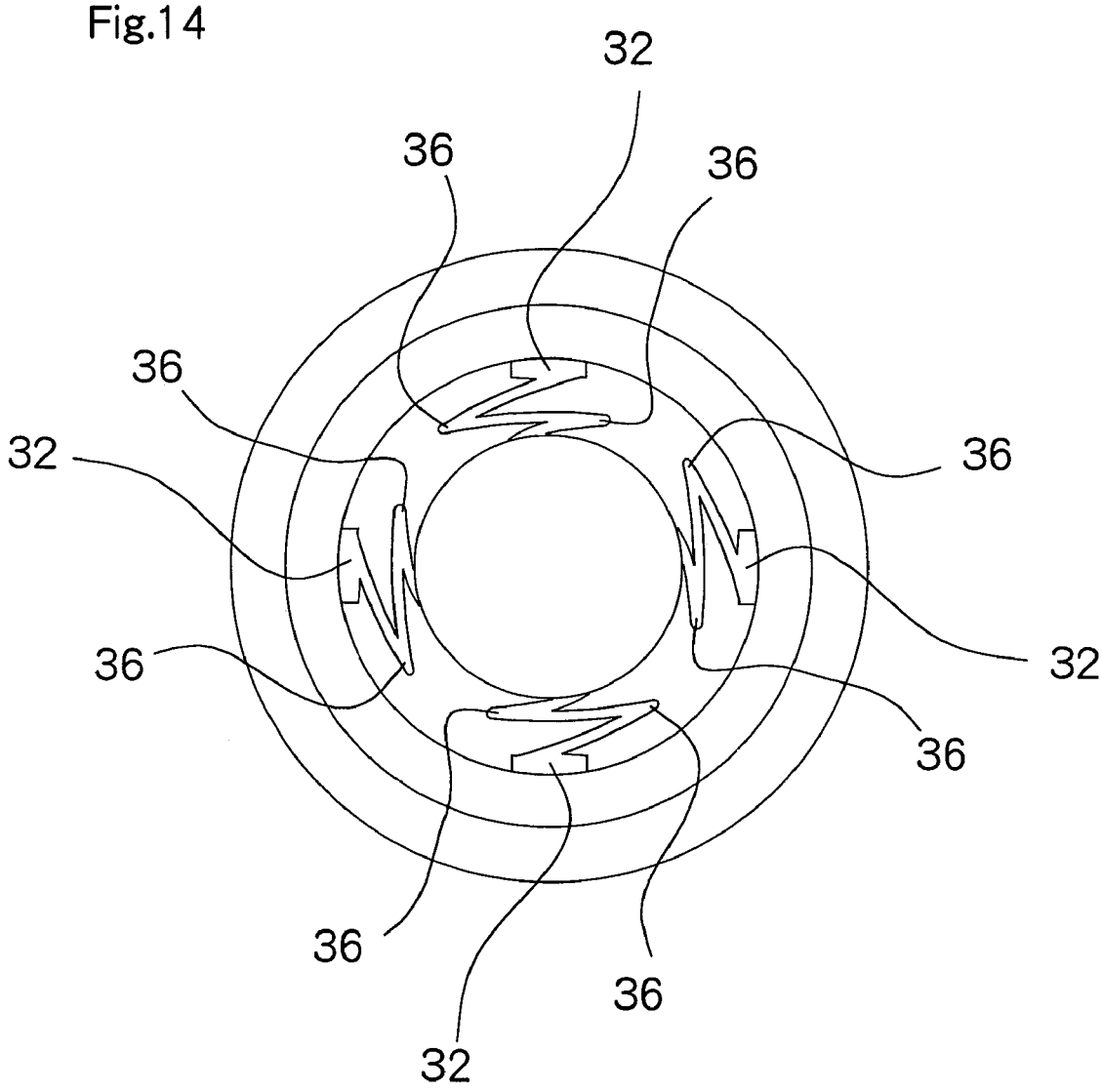
FIG. 14 is a bottom view of the coupling material 30 constituting the valve mechanism 10 according to the present invention.

FIG. 12 is a lateral view of the coupling material 30 constituting the valve mechanism 10 according to the present invention; FIG. 13 is a longitudinal section of the coupling material 30 constituting the valve mechanism 10 according to the present invention; FIG. 14 is a bottom view of the coupling material 30 constituting the valve mechanism 10 according to the present invention.

As shown in FIG. 12, FIG. 13 and FIG. 14, the coupling material 30 has a valve seat material supporting portion 31 which supports the valve seat material 40 which is described later, a valve material supporting portion 33 which supports the engaging portion 22 of the valve material 20, and four coupling portions 32 which couple the valve material supporting portion 31 and the valve material supporting portion 33. On the inner circumferential surface of the valve seat material supporting portion 31, a concave portion 37 is formed. Additionally, in the valve material supporting portion 33, a groove portion 38 which is shorter than a length of the engaging portion 22 in the valve material 20 is formed. By inserting/fitting the engaging portion 22 into this groove portion 38 after passing it through the opening portion 41 of the valve seat material 40 described later, the valve material 20 is fixed with the coupling material 30. Additionally, the four coupling portions 32 comprise flexible resin having a pair of flexions 36 respectively. By the flexibility of these coupling portions 32, the valve body 21 in the valve material 20 is adapted to be able to move between a closed position in which the valve body closes the opening portion 41 in the valve seat material 40 described later and an open position in which the valve body opens the opening portion 41.

Figure 15:
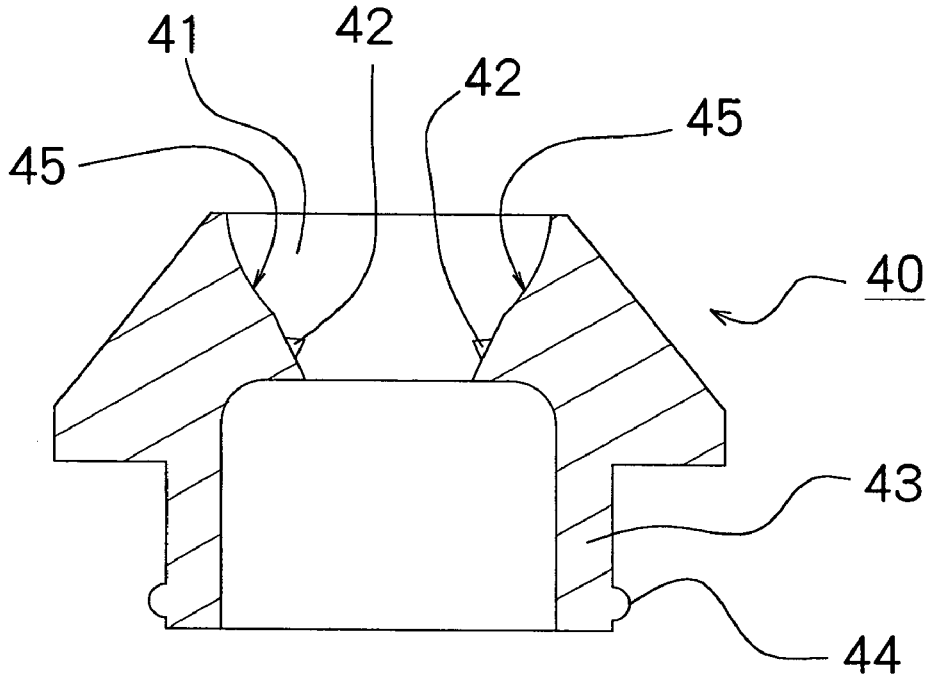
FIG. 15 is a longitudinal section of the valve seat material 40 constituting the valve mechanism 10 according to the present invention.

FIG. 15 is a longitudinal section of the valve seat material 40 constituting the valve mechanism 10 according to the present invention.

As shown in FIG. 15, the valve seat material 40 has the circular opening 41 and an engaging portion 43. The opening portion 41 functions as a valve seat for the valve body 21. An inclined plane 45 forming the opening portion 41 has an angle corresponding to an inclined plane 23 (See FIG. 10.) of the valve body in the valve material 20. In this inclined plane 45, a ring-shaped convex portion 42 is provided. This ring-shaped convex portion 42 functions as a contact portion with the valve body 21 in the opening portion 41. Consequently, even when manufacturing accuracy of each part of the valve mechanism 10 deteriorates, the valve body 21 and the opening portion 41 can be contacted reliably; higher liquid tightness can be maintained as compared with plane contact.

On the outer circumferential surface of the engaging portion 43, a convex portion 44 is formed. Consequently, when this valve seat material 40 is inserted in the coupling material 30, the valve seat material 40 is fixed inside the coupling material 30 with the concave portion 37 (See FIG. 13.) in the coupling material 30 and the convex portion 44 in the valve seat material 40 contacting with each other as shown in FIG. 7.

The valve material 20, the coupling material 30 and the valve seat material 40 are produced by injection molding using synthetic resin such as polyethylene as a material.

In the valve mechanism 10 having this construction, when a pressure is applied to a fluid inside the fluid storing portion 142 by pressing the fluid storing portion 142 of the container main unit 140 as shown in FIG. 7, the valve body 21 in the valve material 20 moves to the open position in which the valve body opens the opening portion 41 in the valve seat material 40 as shown in FIG. 9. By this motion, a fluid passes through the opening portion 41. When the pressure applied to the fluid storing portion 142 is removed, the valve body 21 in the valve material 20 moves to the closed position in which the valve body closes the opening portion 41 in the valve seat material 40. By this, air intrusion into the fluid storing portion 142 from the opening portion 41 can be prevented.

In this valve mechanism 10, because a travel distance of the valve body 21 is changed according to a pressure applied to the fluid storing portion 142, i.e. a pressure applied to the valve mechanism 10, changing a flow rate of the fluid passing through the opening portion 41 discretionally becomes possible. Consequently, when a regular liquid is used as a fluid, discharging the liquid drop by drop by applying a small pressure to the liquid inside the fluid storing portion 142 becomes possible as well.

Additionally, because this valve mechanism 10 has a construction in which the valve body 21 is set up in the vicinity of the end of a flow path of the fluid passing through inside the valve mechanism 10, it becomes possible to minimize an amount of the fluid remaining in an area on the outside of the valve body 21 inside the valve mechanism 10 (the area on the opposite side of the container main unit) when the valve body 21 moves to the closed position.

In this valve mechanism 10, the valve seat supporting portion 31 in the coupling material 30 and the valve material supporting portion 33 are coupled by four coupling portions 32; the coupling material 30 supports the valve material 20 and the valve seat material 40. Consequently, preventing occurrence of an inappropriate tilt in the valve body 21 becomes possible. In this regard, to prevent occurrence of an inappropriate tilt in the valve body 21 effectively, providing three or more coupling portions 32 is preferred and setting them up at even intervals is preferred.

Additionally, in this valve mechanism 10, when the valve body 21 moves from the closed position to the open position, the engaging portion 22 moves while being inserted the opening portion 41. When the valve body 21 tilts inappropriately, the engaging portion 22 contacts the inner walls of the valve seat material 40. Consequently, the valve body 21 does not tilt further.

Furthermore, in this valve mechanism 10, four coupling portions 32 in the coupling material 30 respectively have a pair of flexions 36. Consequently, these coupling portions have adequate elasticity, enabling the valve body 21 in the valve material 20 to reciprocate smoothly between the closed position and the open position.

Additionally, it is preferred that a thickness of these coupling portions 32 is 1 mm or less; a thickness within the range of 0.3 mm to 0.5 mm is more preferably. Additionally, a relation between a pressure applied to the fluid inside the fluid storing portion 142 and a discharge amount of the fluid can be adjusted by changing a thickness, a vertical length or a material (hardness) of these coupling portions 32. Or, the relation between a pressure applied to the fluid inside the fluid storing portion 142 and a discharge amount of the fluid also can be adjusted by changing an elastic force by the coupling portions 32 by changing a thickness or a width of the edge portion on the supporting portion 11 side of the coupling portions 32.

Figure 16:
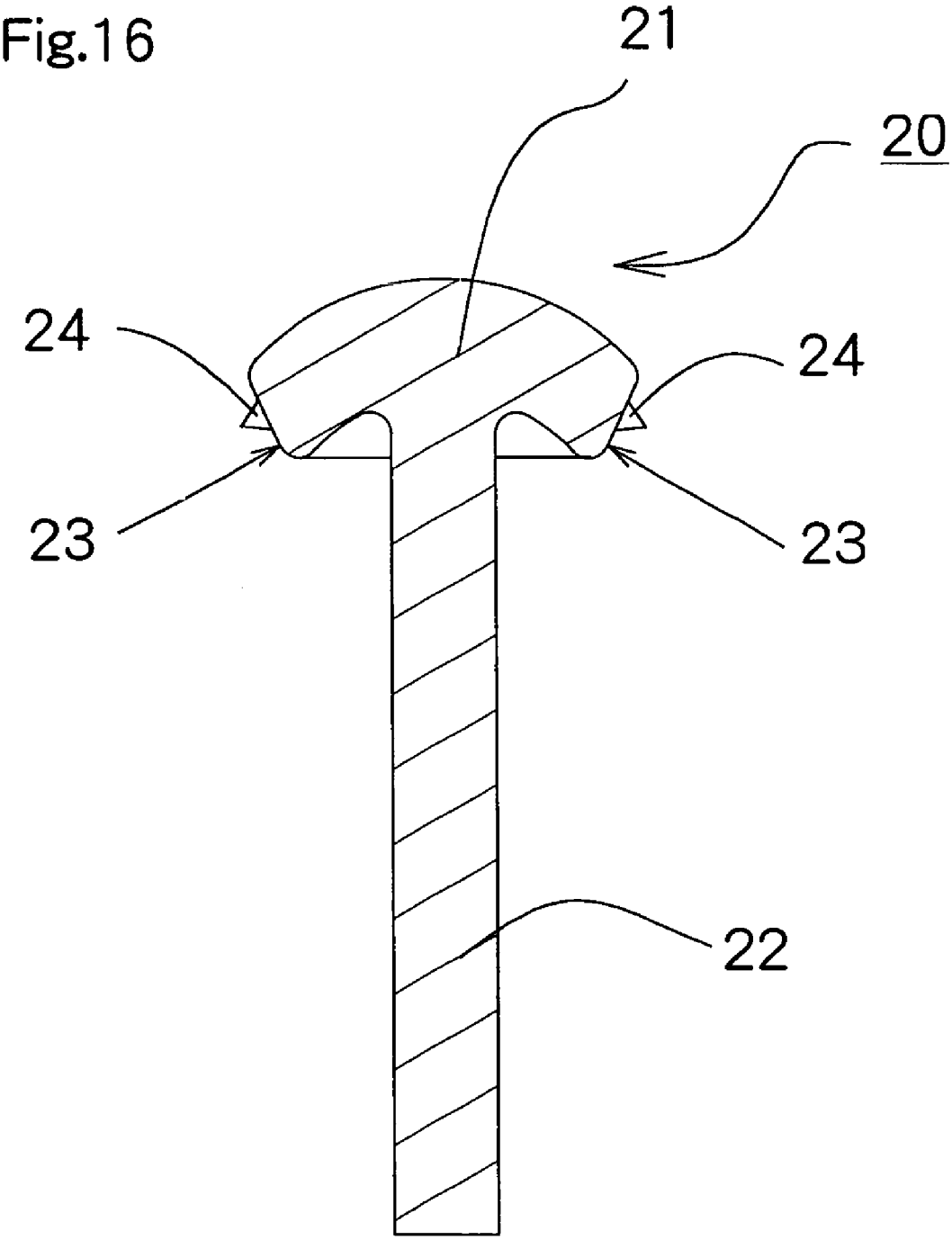
FIG. 16 is a longitudinal section of the valve material 20 according to an alternative embodiment of the present invention.

In the above-mentioned embodiments, a ring-shaped convex portion 42 is formed in the contact portion with the valve body 21 in the opening portion 41 of the valve seat material 40 so that the valve body 21 and the inner walls of the valve seat material 40 can be contacted reliably and higher liquid tightness can be maintained as compared with plane contact even when manufacturing accuracy of each part of the valve mechanism 10 has deteriorated. Additionally, in place of forming the convex portion 42 in the valve seal material 40, as shown in FIG. 16, forming a ring-shaped convex portion 24 facing toward the opening portion 41 in the portion (the inclined plane 23) contacting the opening portion 41 in the valve body 21 can achieve the same effect.

According to the invention described in the fourth aspect, because the invention possesses the valve material having the valve body which is constructed to be able to move between the closed position in which the valve body closes the opening portion in the valve seat material and the open position in which the valve body opens the opening portion by the flexibility of multiple coupling portions, the fluid can be closed reliably while its construction is simple, and it becomes possible to change a flow rate of the fluid passing through the invention discretionally according to a pressure applied to it.

According to the invention described in the fifth aspect, because the valve seat material supporting portion and the valve material supporting portion are coupled by three or more coupling portions, occurrence of an inappropriate tilt in the valve body can be prevented.

According to the invention described in the sixth aspect, because the coupling portions have flexions, the coupling portions have an adequate elasticity recovering force, enabling the valve body to move satisfactorily between the closed position and the open position.

According to the invention described in the seventh aspect, because the ring-shaped convex portion facing toward the valve body is formed, the valve body and the opening portion can be contacted reliably even when manufacturing accuracy of each part of the valve mechanism deteriorates, enabling to maintain higher liquid tightness as compared with plane contact.

According to the invention described in the eighth aspect, because the ring-shaped convex portion facing toward the opening portion is formed in a portion in the valve body which contacts the opening portion, the valve body and the opening portion can be contacted reliably even when manufacturing accuracy of each part of the valve mechanism deteriorates, enabling to maintain higher liquid tightness as compared with plane contact.

Figure 17:
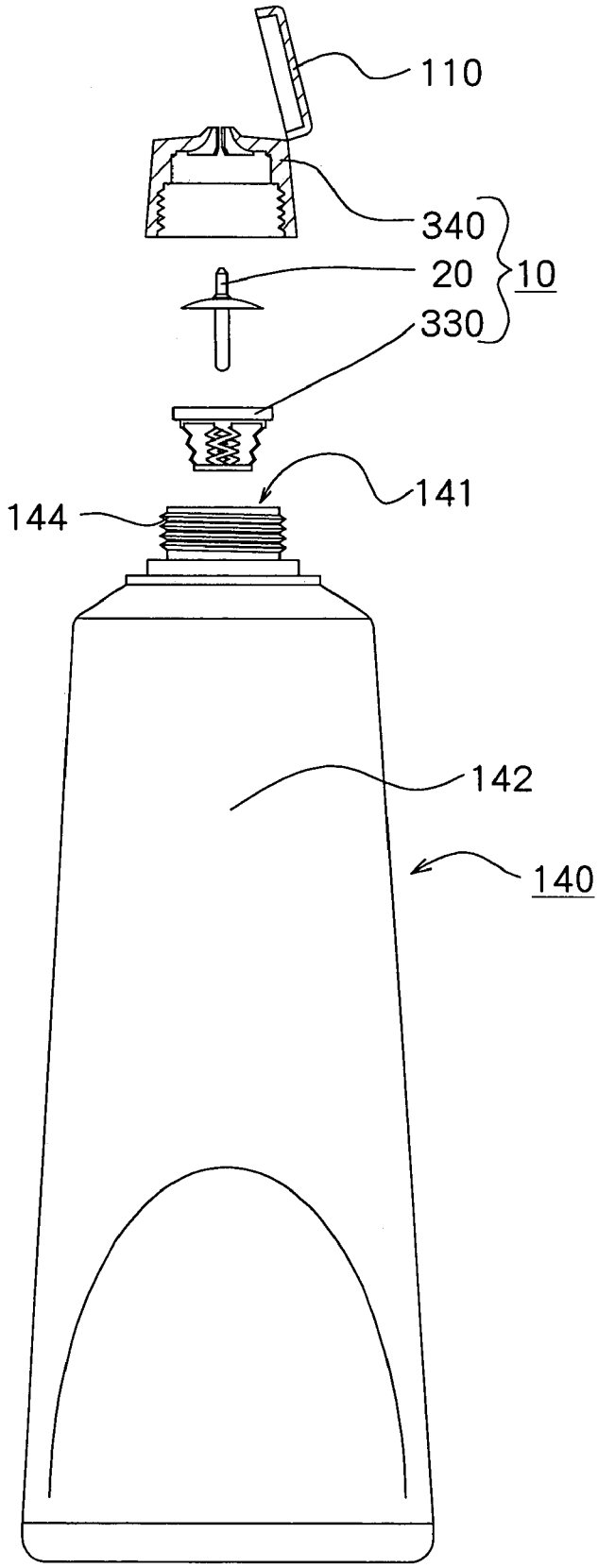
FIG. 17 is an exploded explanatory view of a tube-type container to which the valve mechanism according to the present invention applies.
Figure 18:
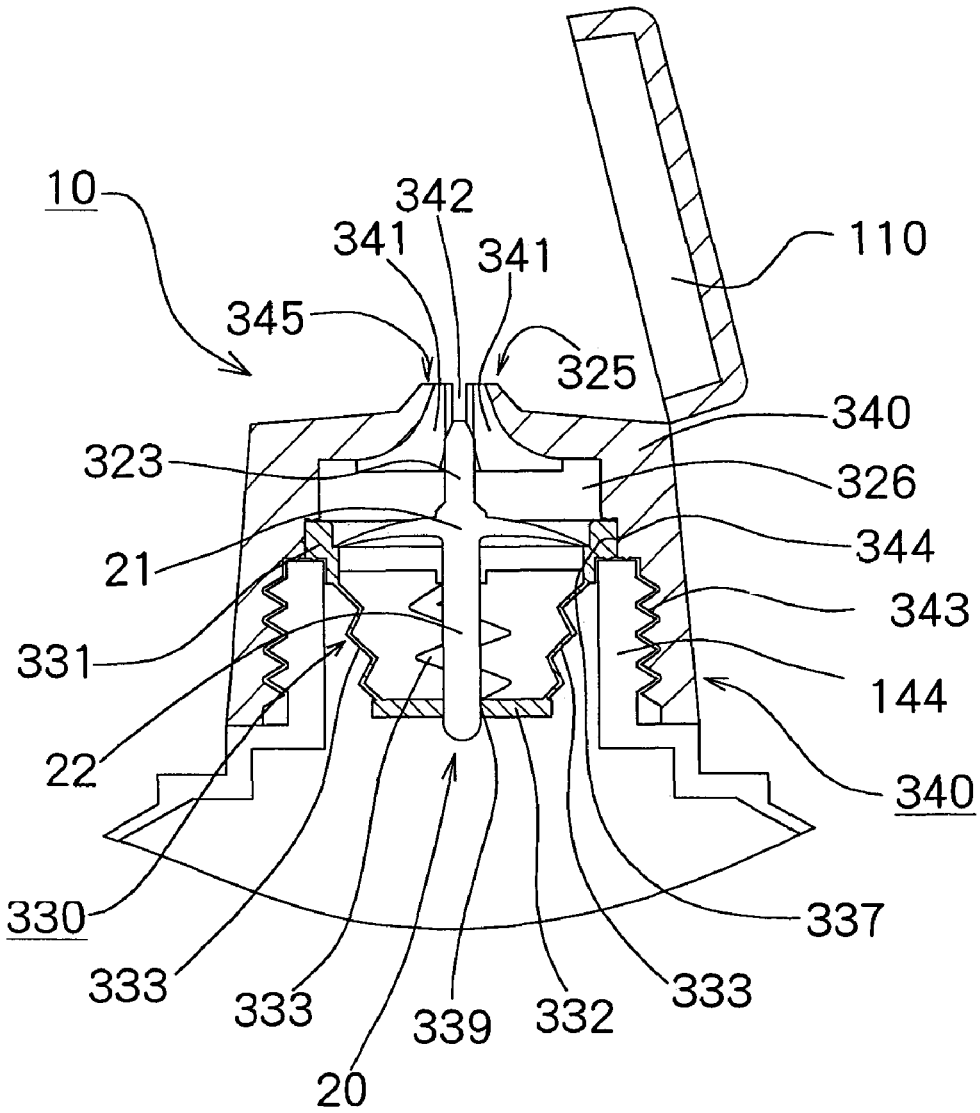
FIG. 18 is an enlarged view of the relevant part of the tube-type container to which the valve mechanism according to the present invention applies.
Figure 19:
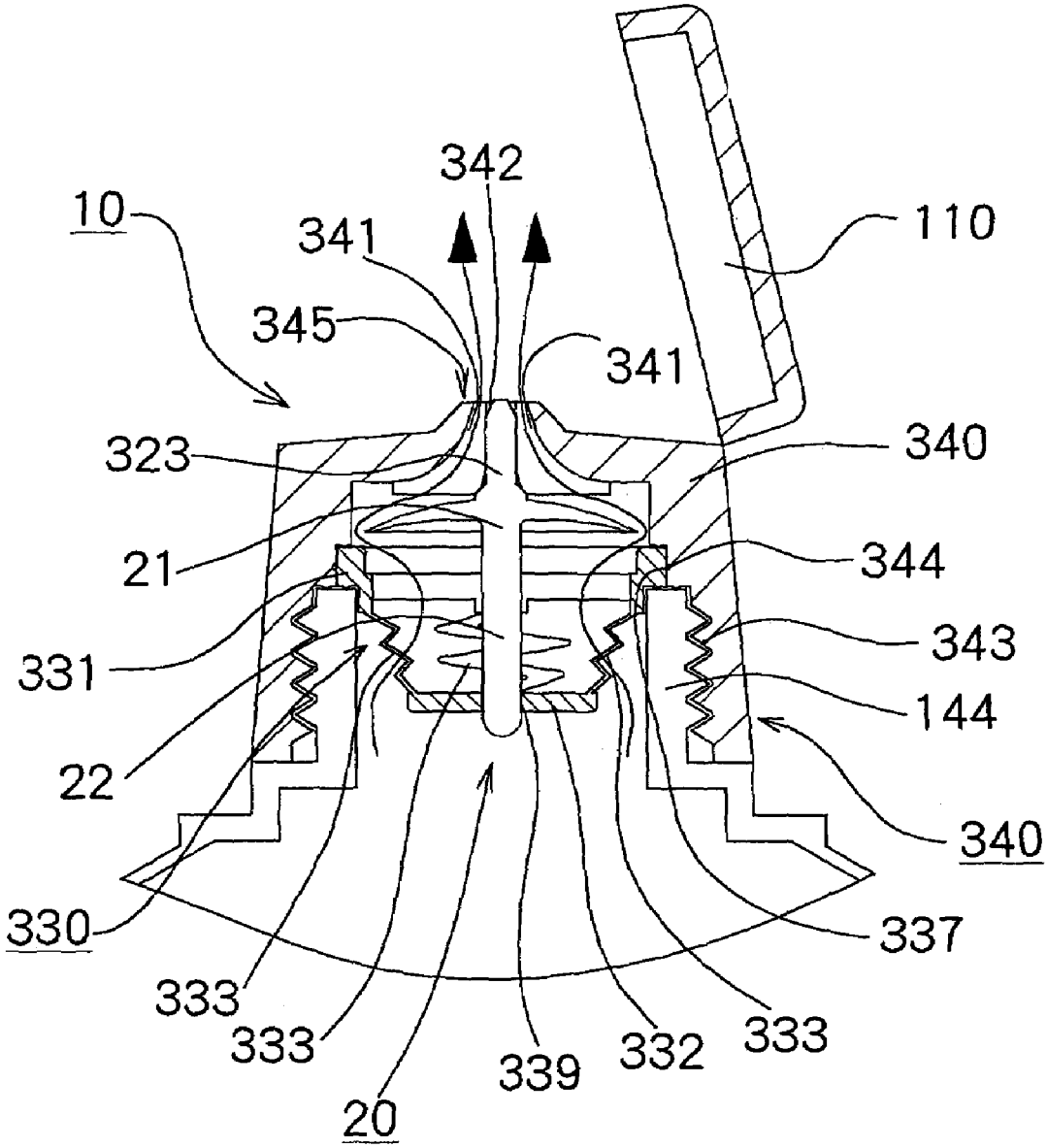
FIG. 19 is an enlarged view of the relevant part of the tube-type container to which the valve mechanism according to the present invention applies.

FIG. 17 is an exploded explanatory view of a tube-type container to which the valve mechanism according to the present invention applies. FIG. 18 and FIG. 19 are enlarged views of the relevant part of the tube-type container to which the valve mechanism according to the present invention applies.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

In this specification, regular liquids, high-viscosity liquids, semifluids, gels that sol solidifies to a jelly, and creams, are all referred to as fluids. The present invention, however, is not limited to a valve mechanism used for the above-mentioned fluids and can apply to a valve mechanism used for the entire fluids including gases.

This tube-type container possesses a container main unit 140, a lid, material 110 which is installed at the top of the container main unit 140 and a valve mechanism 10.

The container main unit 140 comprises a fluid storing portion 142 for storing a fluid inside it, an opening portion 141 for discharging a fluid, which is formed at one end of the fluid storing portion 142, and a male screw portion 144 formed on the outside of the opening portion 141. The male screw portion 144 is constructed to be able to screw together with a female screw portion 343 in the supporting body 340 which is described later. Consequently, the valve mechanism 10 has a construction in which it is fixed inside the opening portion 141 in the container main unit 140 via this female screw portion 343.

This container main unit 140 comprises a synthetic resin alone or a lamination of a synthetic resin and aluminum, and has an elasticity recovering force which tries to recover its original shape when a pressure applied to it is removed.

The above-mentioned lid material 110 is hinged on the supporting body 340 so as to be able to move between a position in which the lid material closes the opening portion 141 of the supporting body 340 in the valve mechanism 10 and a position in which the lid material opens the opening portion.

In the tube-type container having the above-mentioned construction, when a fluid is discharged from the container, a pressure is applied to the fluid inside the fluid storing portion 142 by pressing the fluid storing portion 142 in the container main unit 140. In this position, the valve mechanism 10 comprising the valve material 20, the valve seat material 330 and the supporting body 340 is opened and the fluid inside the fluid storing portion 142 is discharged outward via the opening portion 141 in the valve mechanism 10 as shown in FIG. 19.

When the pressure applied to the fluid storing portion 142 is removed after a necessary amount of the fluid is discharged, the fluid inside the fluid storing portion 142 is depressurized by the elasticity recovering force of the container main unit 140; the air tries to flow back toward the fluid storing portion 142 from the opening portion 141 for discharging the fluid.

In this tube-type container, however, a flow path for the fluid is closed by the action of the valve mechanism 10 comprising the valve material 20, the valve seat material 330 and the supporting body 340. Consequently, the reverse flow of the air can be prevented effectively.

Figure 20A:
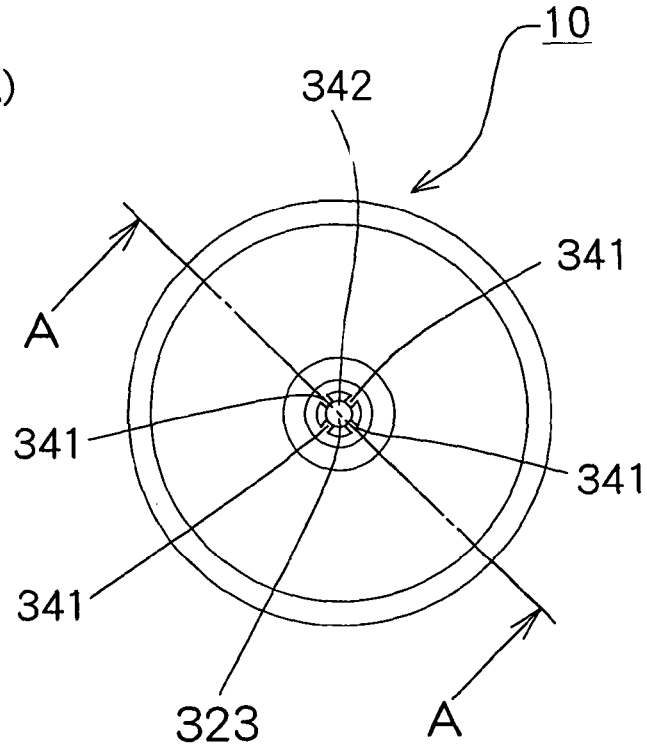
FIG. 20(A) is a plan view of the valve mechanism 10 according to the present invention.
Figure 20B:
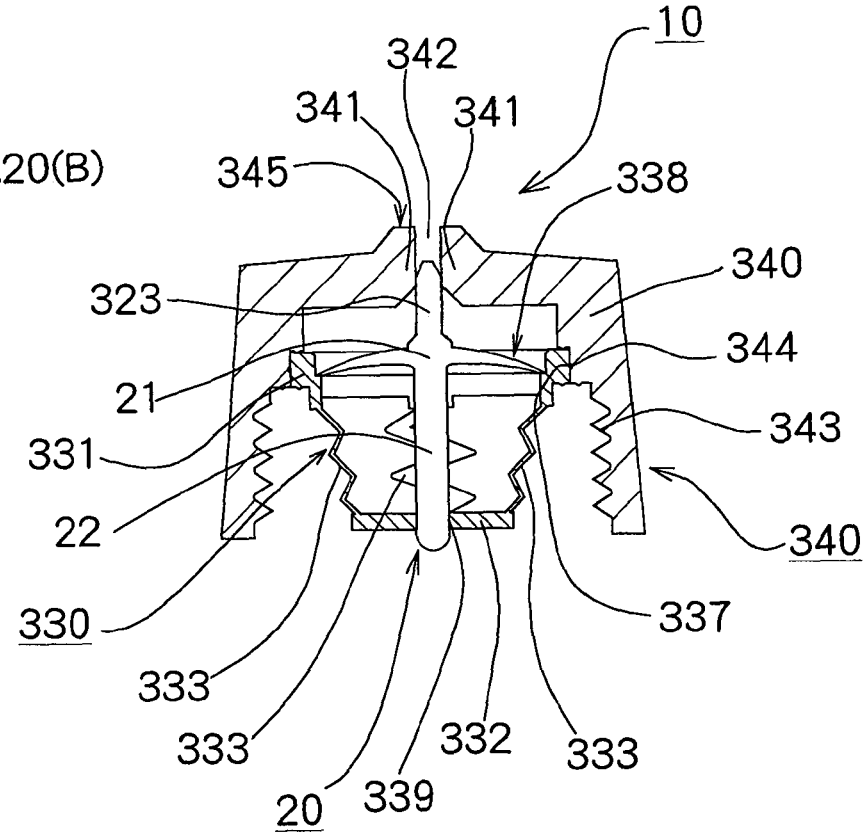
FIG. 20(B) is a longitudinal section showing the A-A section in FIG. 20 (A).

A construction of the valve mechanism 10 according to the present invention is described below. FIG. 20(A) is a plan view of the valve mechanism 10 according to the present invention; FIG. 20(B) is a longitudinal section showing the A-A section of FIG. 20(A). As shown in FIG. 17, the valve mechanism 10 comprises the valve material 20, the valve seat material 330 and the supporting body 340.

Figure 21A:
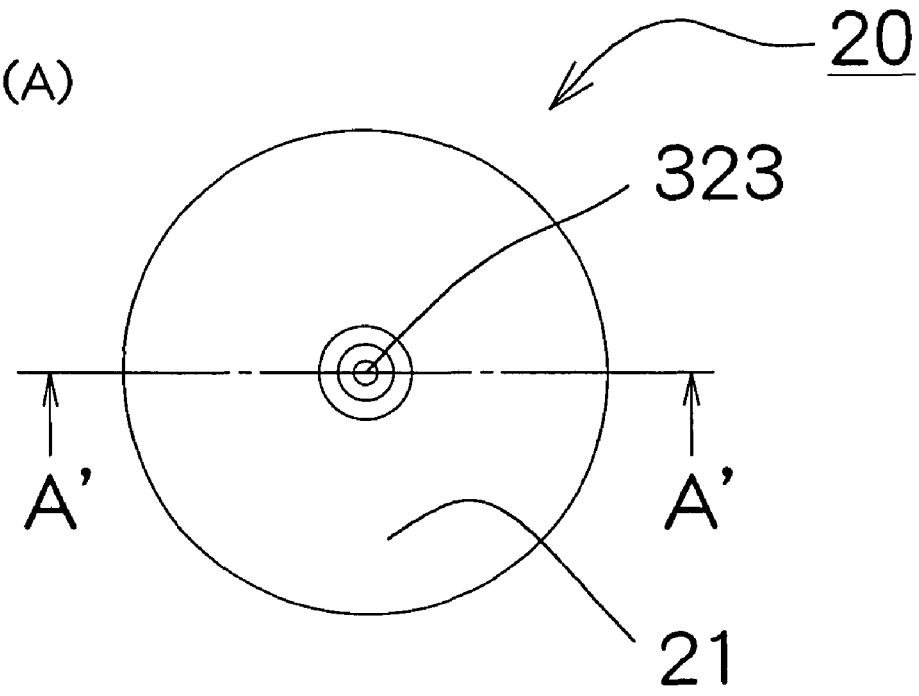
FIG. 21(A) is a plan view of the valve material 20 constituting the valve mechanism 10 according to the present invention.
Figure 21B:
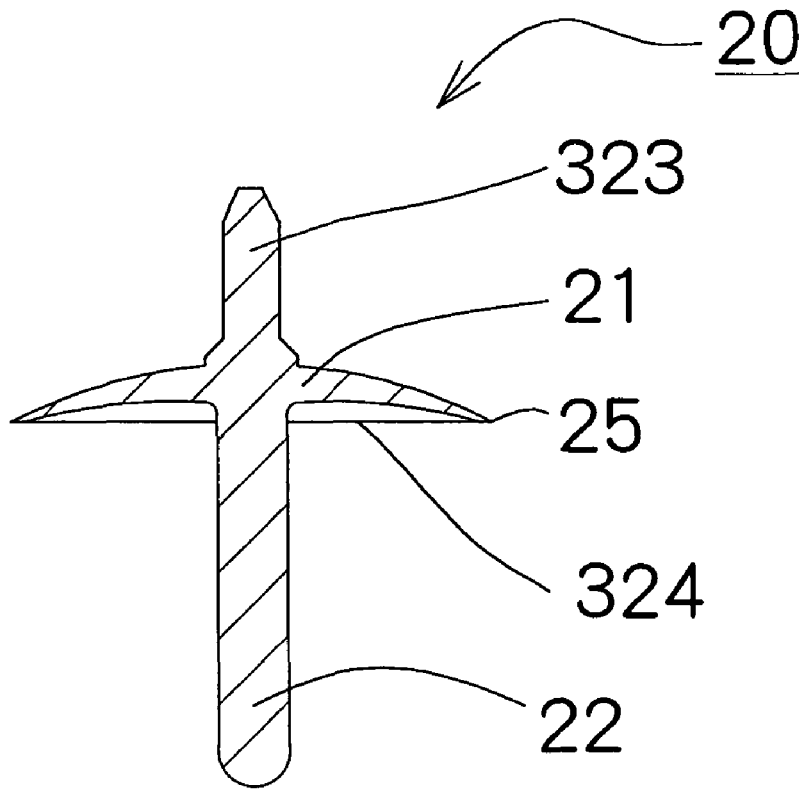
FIG. 21(B) is a longitudinal section showing the A'-A' section in FIG. 21(A).

FIG. 21(A) is a plan view of the valve material 20 constituting the valve mechanism 10 according to the present invention. FIG. 21(B) is a longitudinal section showing the A'-A' section of FIG. 21(A).

As shown in FIG. 21, the valve material 20 possesses a valve body 21, an engaging portion 22 having a nearly cylindrical shape, which is set up by standing it in the valve body, and a guide portion 323 having a nearly cylindrical shape, which is set up by standing it on the side opposite to the engaging portion 22 in the valve body 21.

Figure 22A:
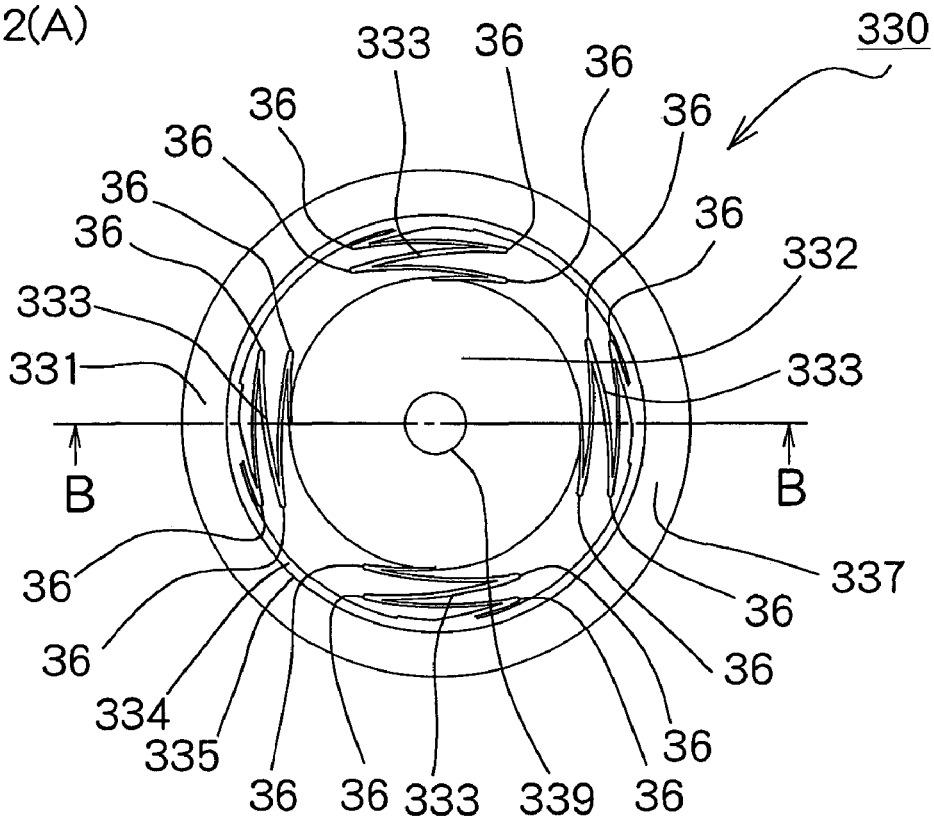
FIG. 22(A) is a plan view of the valve seat material 330 constituting the valve mechanism 10 according to the present invention.
Figure 22B:
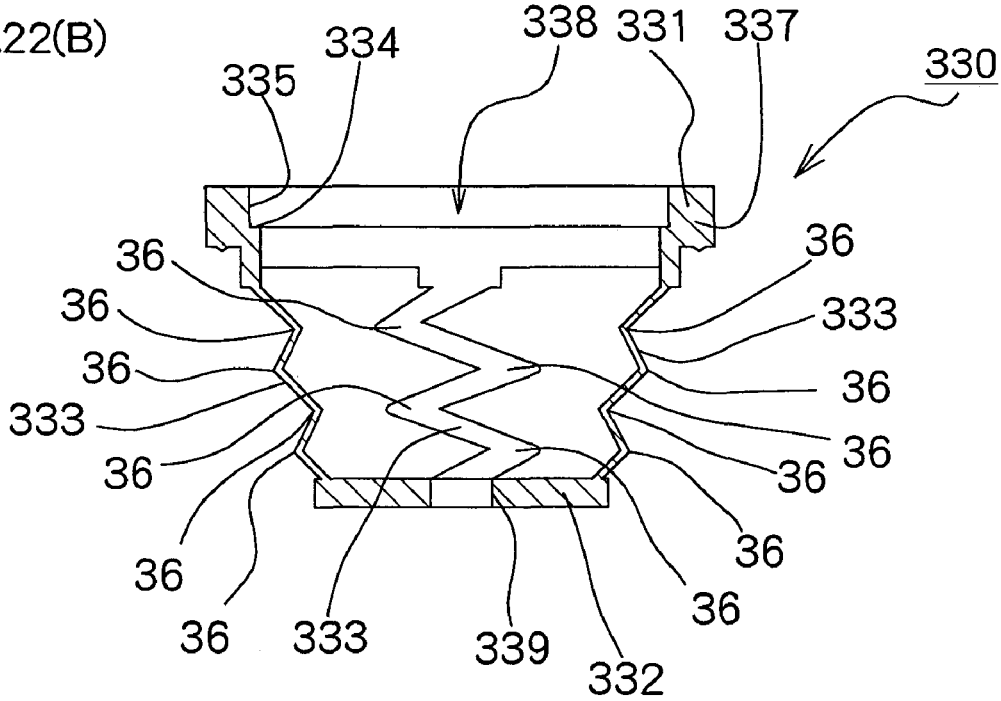
FIG. 22(B) is a longitudinal section showing the B-B section in FIG. 22(A).

FIG. 22(A) is a plan view of the valve seat material 330 constituting the valve mechanism 10 according to the present invention; FIG. 22(B) is a longitudinal section showing the B-B section of FIG. 22(A).

As shown in FIG. 22, the valve seat material 330 possesses a valve seat portion 331 having a circular opening portion 338 which functions as a valve seat for the valve body 21 in the valve material 20, a valve material supporting portion 332 which engages with the engaging portion 22 in the valve material 20, and four coupling portions 333 having flexibility, which couple the valve portion 331 and the valve material supporting portion 332.

On the outer circumferential surface of the valve seat material 330, a concave portion 337 is formed. Consequently, with this convex portion 337 engaging with a concave portion 344 formed on the inner circumferential surface of the supporting body 340 described later, the valve seat material 330 is fixed with the supporting body 340. Additionally, in the valve material supporting portion 332 in the valve seat material 330, a groove portion 339 is formed. By inserting/fitting the engaging portion 22 in the valve material into this groove portion 339, the valve material 20 and the valve seat material 330 are engaged. Additionally, the valve seat portion 331 has a level surface 334 and a vertical surface 335 in its opening portion 338. When the valve material 20 is positioned in a closed position in which the opening portion 338 in the valve seat material 330 is closed, the under surface 324 of the valve body 21 contacts the level surface 334 of the valve seat portion 331 and the end surface 25 of the valve body 21 contacts the vertical surface 335 of the valve seat portion 331.

The four coupling portions 333 comprise flexible resin having a pair of flexions 36 respectively. By the flexibility of these coupling portions 333, the valve body 21 in the valve material 20 is adapted to be able to move between the closed position in which the valve body closes the opening portion 338 in the valve seat material 330 and an open position in which the valve body opens the opening portion 338.

Figure 23A:
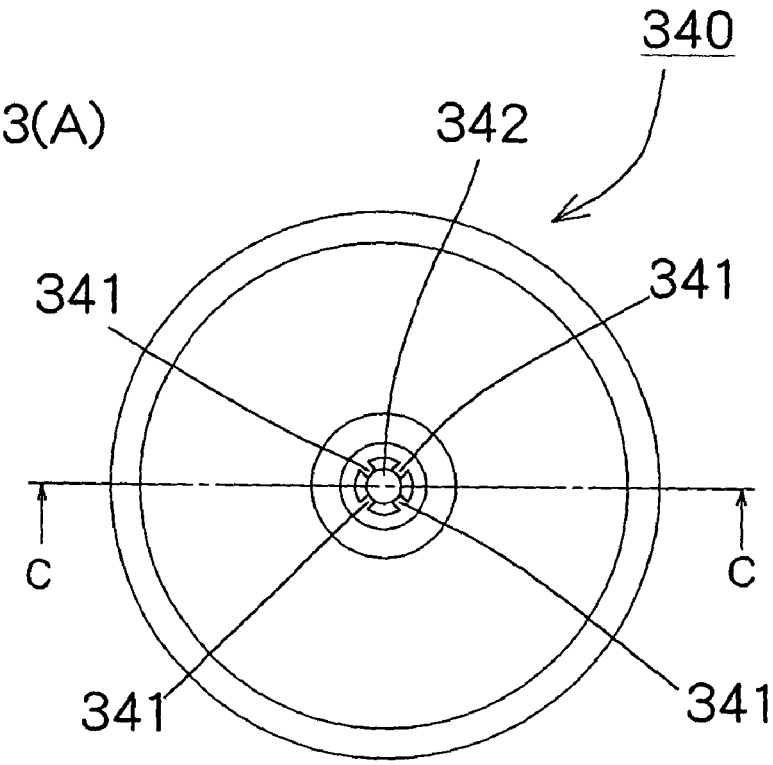
FIG. 23(A) is a plan view of the supporting body 340 constituting the valve mechanism 10 according to the present invention.
Figure 23B:
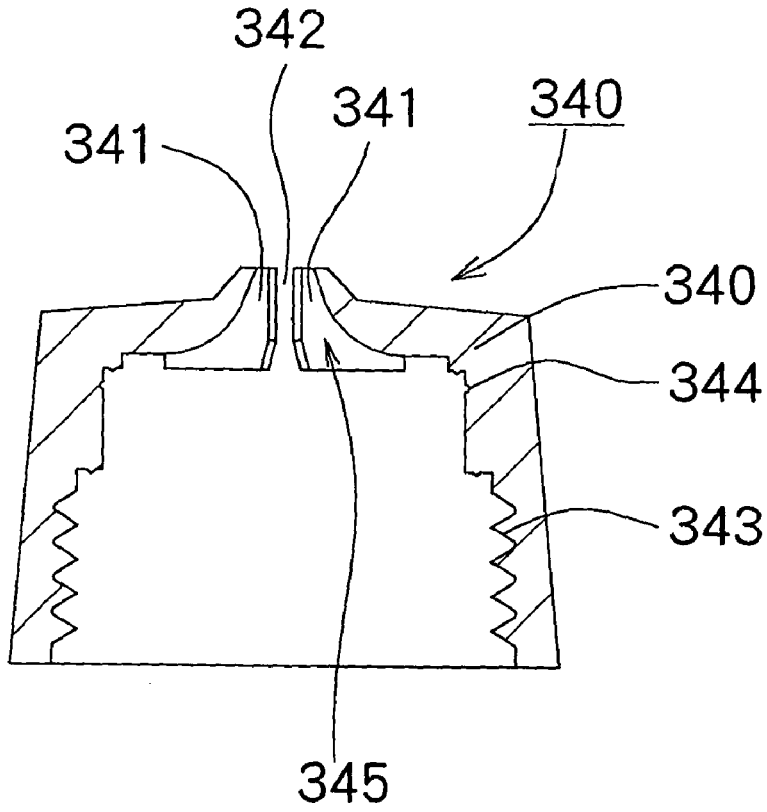
FIG. 23(B) is a longitudinal section showing the C-C section in FIG. 23(A).

FIG. 23(A) is a plan view of the supporting body 340 constituting the valve mechanism 10 according to the present invention. FIG. 23(B) is a longitudinal section showing the C-C section of FIG. 23(A).

The supporting body 340 possesses an opening portion 345 for letting the fluid passing through the above-mentioned opening portion 338 flow outwardly, and four ribs 341 provided at the opening portion 345. The four ribs are set up inside the opening portion 345 at even intervals, forming a guide path 342.

Inside the supporting body 340, a cylindrical hollow portion is formed. Additionally, inside this hollow portion, the supporting body 340 possesses a female screw portion 343 which can screw together with a male screw portion 144 in the container main unit 140 and a concave portion 344 (See FIG. 20.) which can engage with the convex portion 337 in the valve seat material 330. Consequently, by inserting the valve seat material 330 which is engaged with the valve material 20 inside the support body 340, the valve material 20, the valve seat material 330 and the supporting body 340 are engaged. At this time, the guide portion 323 in the valve material 20 is engaged while being inserted in the guide path 342 surrounded by the four ribs 341.

The valve mechanism 10 being engaged in this manner is fixed inside the opening portion 141 in the container main unit 140 with the female screw portion 343 in the supporting body 340 and the male screw portion 144 formed in the container main unit 140 being screwed together and engaged with each other.

The valve material 20, the valve seat material 330 and the supporting body 340 are produced by injection molding, etc. using synthetic resin such as polyethylene, synthetic rubber such as silicon rubber or a mixture of these materials as a material.

In this valve mechanism 10, when a pressure is applied to a fluid inside the fluid storing portion 142 by pressing the fluid storing portion 142 of the container main unit 140 shown in FIG. 17, the valve body 21 in the valve material 20 moves to the open position in which the valve body opens the opening portion 338 in the supporting body 340 as shown in FIG. 19. By this motion, the fluid passes through the opening portion 338. When the pressure applied to the fluid storing portion 142 is removed, the valve body 21 in the valve material 20 moves to the closed, position in which the valve body closes the opening portion 338 in the supporting body 340 by the elasticity recovering force of the four coupling portions 333. By this, air intrusion into the fluid storing portion 142 from the opening portion 338 can be prevented.

In this valve mechanism 10, because a travel distance of the valve body 21 is changed according to a pressure applied to the fluid storing portion 142, i.e. a pressure applied to the valve mechanism 10, changing a flow rate of the fluid passing through the opening portion 338 discretionally becomes possible. Consequently, when a regular liquid is used as a fluid, discharging the liquid drop by drop by applying a small pressure to the liquid inside the fluid storing portion 142 becomes possible as well. Additionally, because the valve seat portion 331 has the level surface 334 and the vertical surface 335 in its opening portion 338, the valve body 21 moves according to a pressure applied to the valve mechanism 10; even in a position in which the under surface 324 of the valve body 21 does not contact the level surface 334 of the valve seat portion 331, the fluid cannot pass through as long as the end surface 25 of the valve body 21 contacts the vertical surface 335 of the valve seat portion 331. Consequently, unless a pressure above a certain level is applied to the fluid storing portion 142, it becomes possible to prevent fluid leakage from the opening portion 338.

In this valve mechanism 10, the valve seat supporting portion 331 and the valve material supporting portion 332 in the valve seat material 330 are coupled by four coupling portions 333. Consequently, it becomes possible to prevent occurrence of an inappropriate tilt in the valve body 21. Additionally, to prevent occurrence of an inappropriate tilt in the valve body 21, it is preferred to provide three or more coupling portions 333 and it is preferred to set them up at even intervals.

Additionally, in this valve mechanism 10, when the valve body 21 moves between the closed position and the open position, the guide portion 323 moves while being inserted in the guide path 342 surrounded by four ribs 341. When an inappropriate tilt occurs in the valve body 21, therefore, the guide portion 323 is to contact the ribs 341. Consequently, the valve body 21 does not tilt further.

Furthermore, in this valve mechanism 10, four coupling portions 333 in the valve seat material 330 respectively have a pair of flexions 36. Consequently, these coupling portions 333 have adequate elasticity, enabling the valve body 21 in the valve material 20 to reciprocate smoothly between the closed position and the open position.

Additionally, it is preferred that a thickness of these coupling portions 333 is 1 mm or less; a thickness within the range of 0.3 mm to 0.5 mm is more preferably. Additionally, a relation between a pressure applied to the fluid inside the fluid storing portion 142 and a discharge amount of the fluid can be adjusted by changing a thickness, a vertical length or a material (hardness) of these coupling portions 333. Or, the relation between a pressure applied to the fluid inside the fluid storing portion 142 and a discharge amount of the fluid also can be adjusted by changing an elastic force by the coupling portions 333 by changing a thickness or a width of the edge portion on the supporting portion 11 side of the coupling portions 333. Further, the relation between a pressure applied to the fluid inside the fluid storing portion 142 and a travel distance of the valve body 21, and a discharge amount of the fluid can be adjusted by changing a thickness of the valve body 21.

Figure 24:
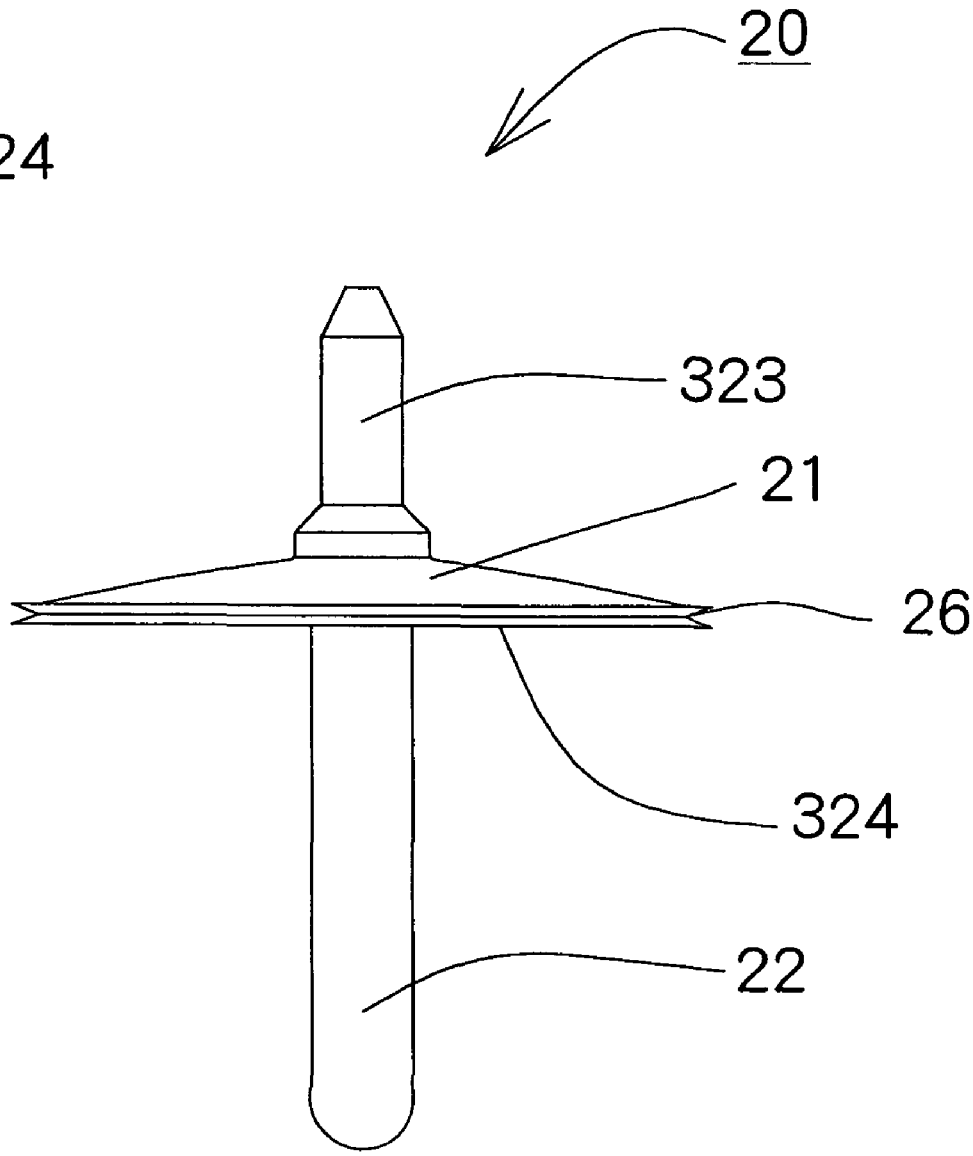
FIG. 24 is a lateral view of an embodiment in which a groove portion 26 is provided on the circumferential surface of the end surface 25 of the valve body 21 in the valve material 20 constituting the valve mechanism 10 according to the present invention.
Figure 25:
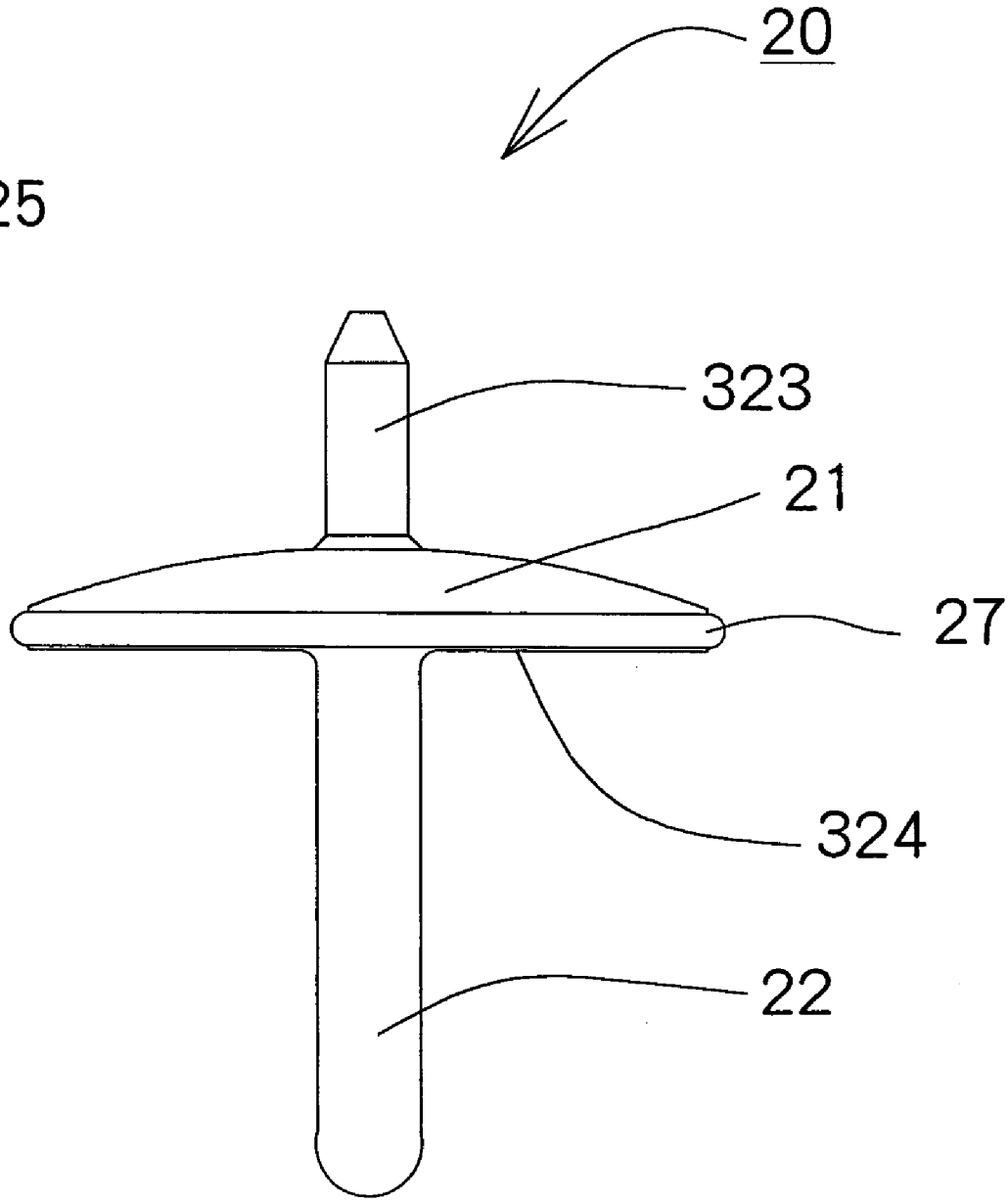
FIG. 25 is a lateral view of an embodiment in which an O-ring 27 is combined with the valve material 20 shown in FIG. 24.

FIG. 24 is a lateral view of an embodiment in which a groove portion 26 is provided on the circumferential portion of the end surface of the valve body 211 in the valve material 20 which comprises the valve mechanism 10 according to the present invention. FIG. 25 is a lateral view of an embodiment in which an O-ring 27 is combined with the valve material 20 shown in FIG. 24. As shown in FIG. 24, because the end surface 25 of the valve body 21 in the valve material 20 contacts the vertical surface 335 in the supporting body 340 at two places, higher liquid tightness can be achieved. Additionally, as shown in FIG. 25, by the elasticity of the O-ring 27 which is combined with the end surface 25 of the valve body 21 in the valve material 20, the valve body 21 and the inner walls of the valve seat material 330 can be contacted reliably even when manufacturing accuracy of each part of the valve mechanism 10 has deteriorated, and higher liquid tightness can be maintained as compared with plane contact.

According to the invention described in the ninth aspect, because the valve material possesses a valve material having a valve body, an engaging portion set up by standing it in the valve body and a guide portion set up by standing it on the side opposite to the engaging portion in the valve body, a valve seat material possessing a valve seat portion which has a circular opening portion functioning as a valve seat for the valve body, a valve material supporting portion which engages with the engaging portion and multiple coupling portions having flexibility which couple the valve seat portion and the valve material supporting portion, and a supporting body possessing an opening portion for discharging a fluid and a guide material guiding the guide portion, it becomes possible to prevent occurrence of an inappropriate tilt in the valve body when the valve body moves between the closed position in which the valve body closes the opening portion in the valve seat material and the open position in which the valve body opens the opening portion. Consequently, flowing out of the fluid can be prevented reliably.

According to the invention described in the tenth aspect, because in the valve mechanism described in claim 1, the guide material comprises multiple ribs contacting the outer circumferential surface of the guide portion, it becomes possible to prevent occurrence of an inappropriate tilt in the valve body while having a simple construction, when the valve body moves between the closed position in which the valve body closes the opening portion in the valve seat material and the open position in which the valve body opens the opening portion.

According to the invention described in the eleventh aspect, because in the valve mechanism described in the ninth or tenth aspect, the valve seat portion contacts the under surface and the end surface of the valve body in a position in which the valve material is positioned in the closed position, the valve mechanism does not let the fluid pass through as long as the end surface of the valve body contacts the vertical surface of the valve seat portion. Consequently, unless a pressure above a certain level is applied to the fluid storing portion, it becomes possible to prevent fluid leakage from the opening portion.

According to the invention described in the twelfth aspect, because in the valve mechanism described in the ninth to eleventh aspects, the valve seat material has three or more coupling portions, it becomes possible to prevent occurrence of an inappropriate tilt in the valve body.

According to the invention described in the thirteenth aspect, because in the valve mechanism described in the ninth to twelfth aspects, the coupling portions have flexions, the coupling portions have adequate elasticity, enabling the valve body in the valve material to reciprocate between the closed position and the open position smoothly.

Figure 26:
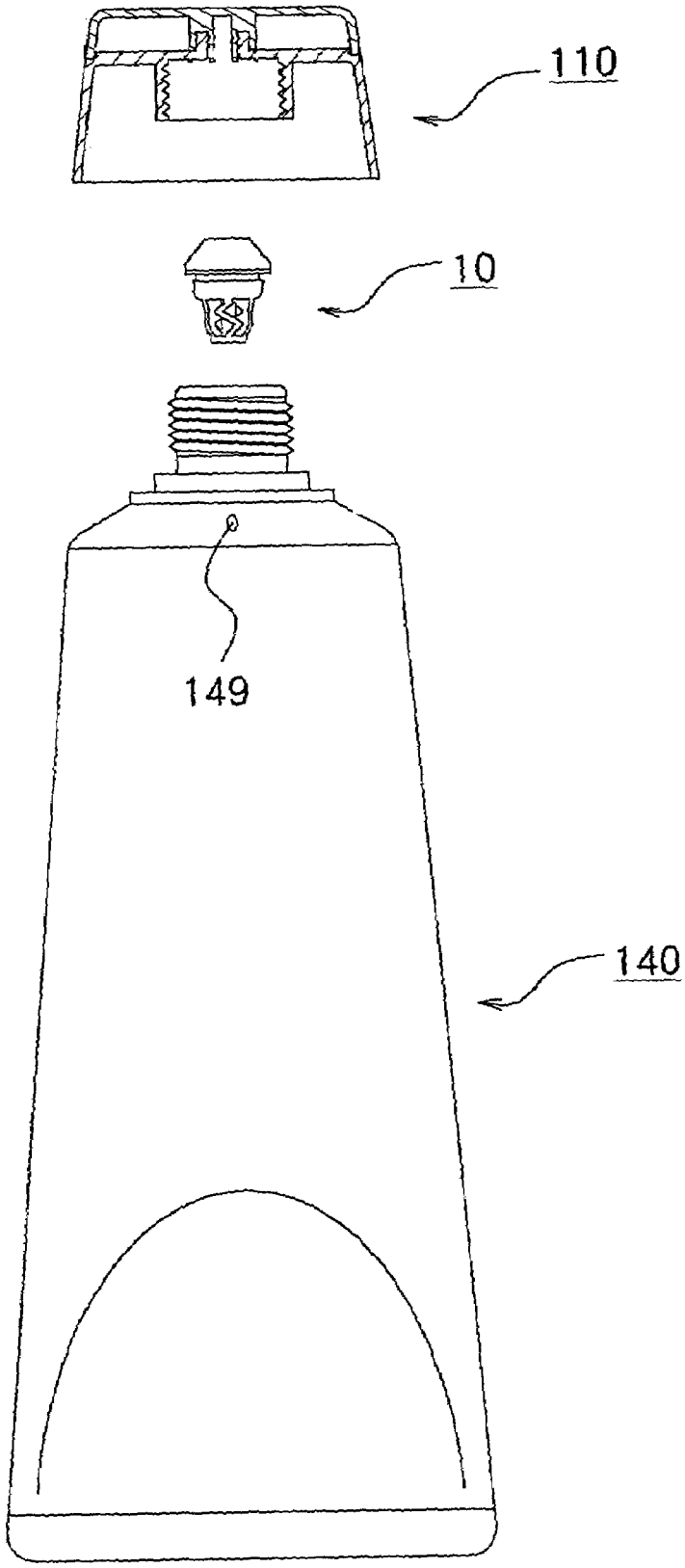
FIG. 26 shows a front view of the tube-type container according to the present invention.
Figure 27:
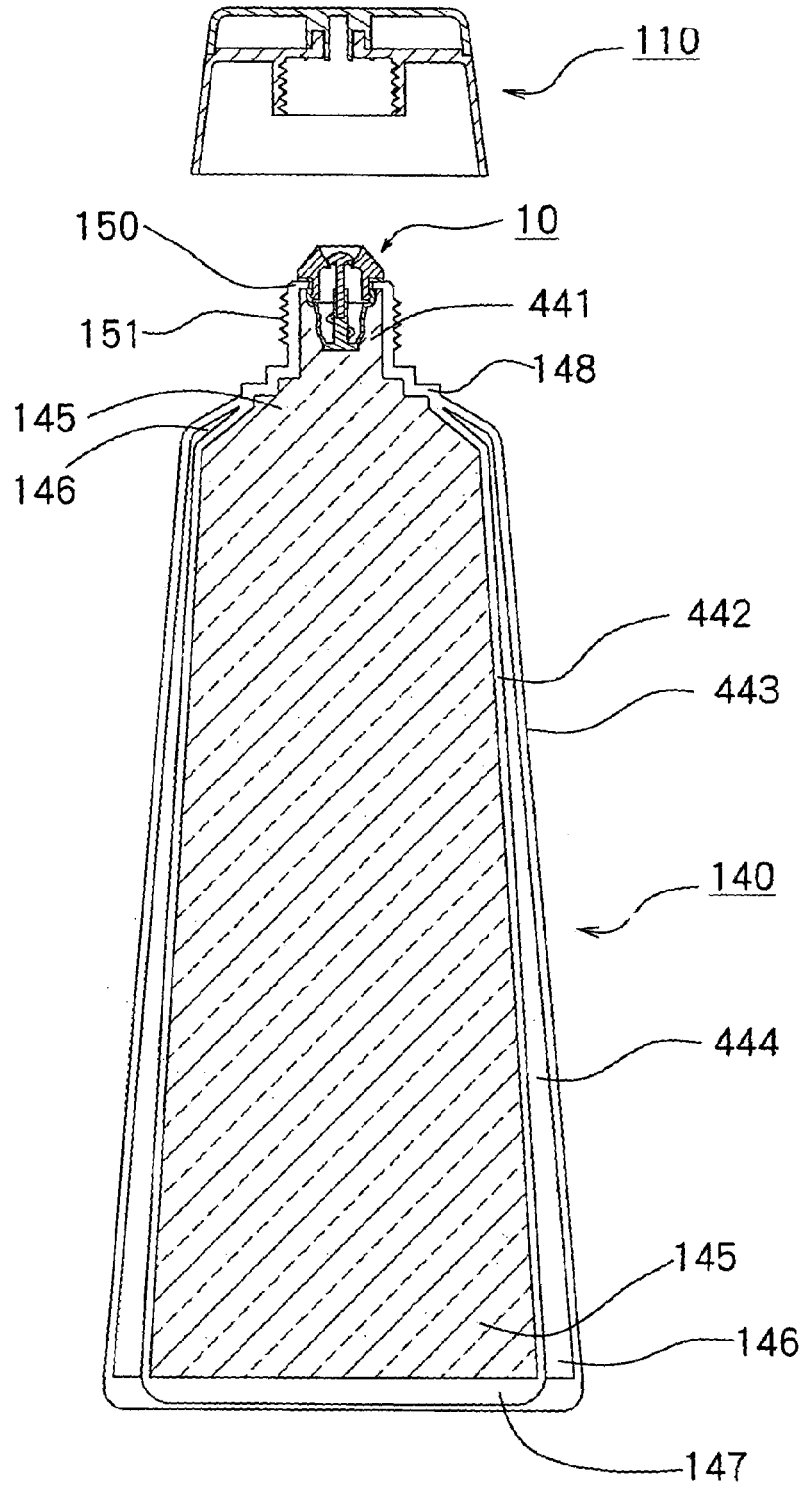
FIG. 27 shows a longitudinal section of the tube-type container according to the present invention.

FIG. 26 is a front view of the tube-type fluid container according to Embodiment 4 of the present invention. FIG. 27 is its longitudinal section.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

In this specification, high-viscosity liquids, semifluids, gels that sol solidifies to a jelly, and creams, and regular liquids, are all referred to as fluids.

This tube-type container possesses a container main unit 140, a lid material 110 which is placed at the top of the container main unit 140, and a valve mechanism 10.

The container main unit 140 possesses a discharge port 441 for discharging a fluid, which is formed at one end of the container main unit, a flange portion 150 (See FIG. 35 and FIG. 36) formed in the vicinity of the upper end of the discharge port 441, and a male screw portion 151 formed outside the discharge port 441. The above-mentioned flange portion can engage with an engaging groove 35 in a coupling material 30 in the valve mechanism 10 which is described later in detail by referring to FIG. 35 and FIG. 36. Consequently, the valve mechanism 10 is constructed to be fixed inside the discharge port 441 in the container main unit 140 through this engaging groove 35.

The lid material 110 possesses a lid body 111 and a female screw portion 415 formed at the center of the lid body 111. The female screw portion 415 in the lid body 111 is constructed to screw together with the male screw portion 151 in the container main unit 140.

In the tube-type container having the above-mentioned construction, when a fluid is discharged from the container, a pressure is applied to the fluid inside the container main unit 140. In this position, the valve mechanism 10 comprising a valve material 20, a coupling material 30 and a valve seat material is opened and the fluid inside the container main unit 140 is discharged outward via an opening portion 41 in the valve mechanism 10. After a necessary amount of the fluid is discharged and when the pressure applied to the fluid storing portion 442 is removed, the fluid inside the fluid storing portion 442 is depressurized by the elasticity recovering force of the container main unit 140 and the air tries to flow back toward the container main unit 140 from the discharge port 441 used for discharging the fluid.

In this tube-type container, however, by the action of the valve mechanism comprising the valve material 20, the coupling material 30 and the valve seating material 40, a path in which the fluid passes through is closed. Consequently, reverse air flow can be effectively prevented.

Figure 35:
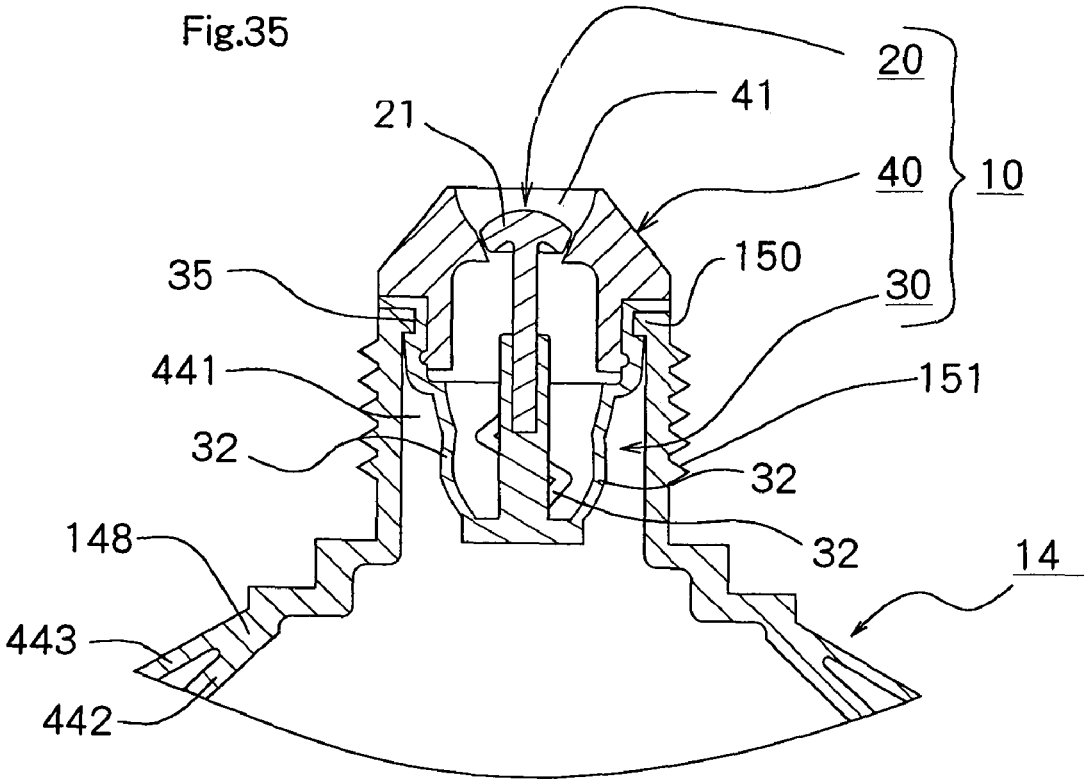
FIG. 35 shows an enlarged view showing the valve mechanism 10 in the tube-type fluid container according to Embodiment 4 of the present invention along with the top of the container main unit 140.
Figure 36:
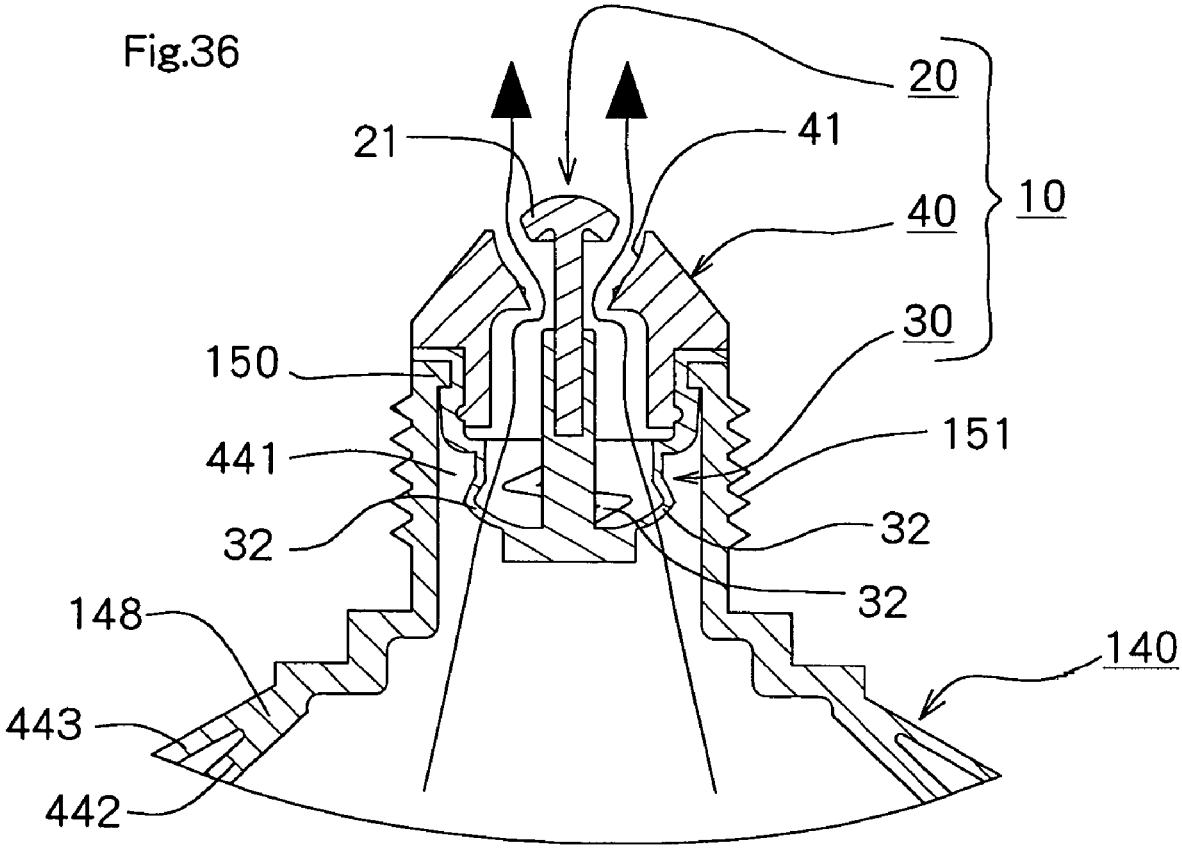
FIG. 36 shows an enlarged view showing the valve mechanism 10 in the tube-type fluid container according to Embodiment 4 of the present invention along with the top of the container main unit 140.

A construction of the valve mechanism 10 which is applied to the tube-type fluid container according to Embodiment 4 of the present invention is described below. FIG. 35 and FIG. 36 show enlarged views of the valve mechanism 10 along with the top of the container main unit 140.

This valve mechanism 10 comprises a valve material 20, a coupling material 30 and a valve seat material 40.

The explanation regarding FIGS. 10-15 as mentioned above is applied to Embodiment 4 of the present invention.

Figure 28:
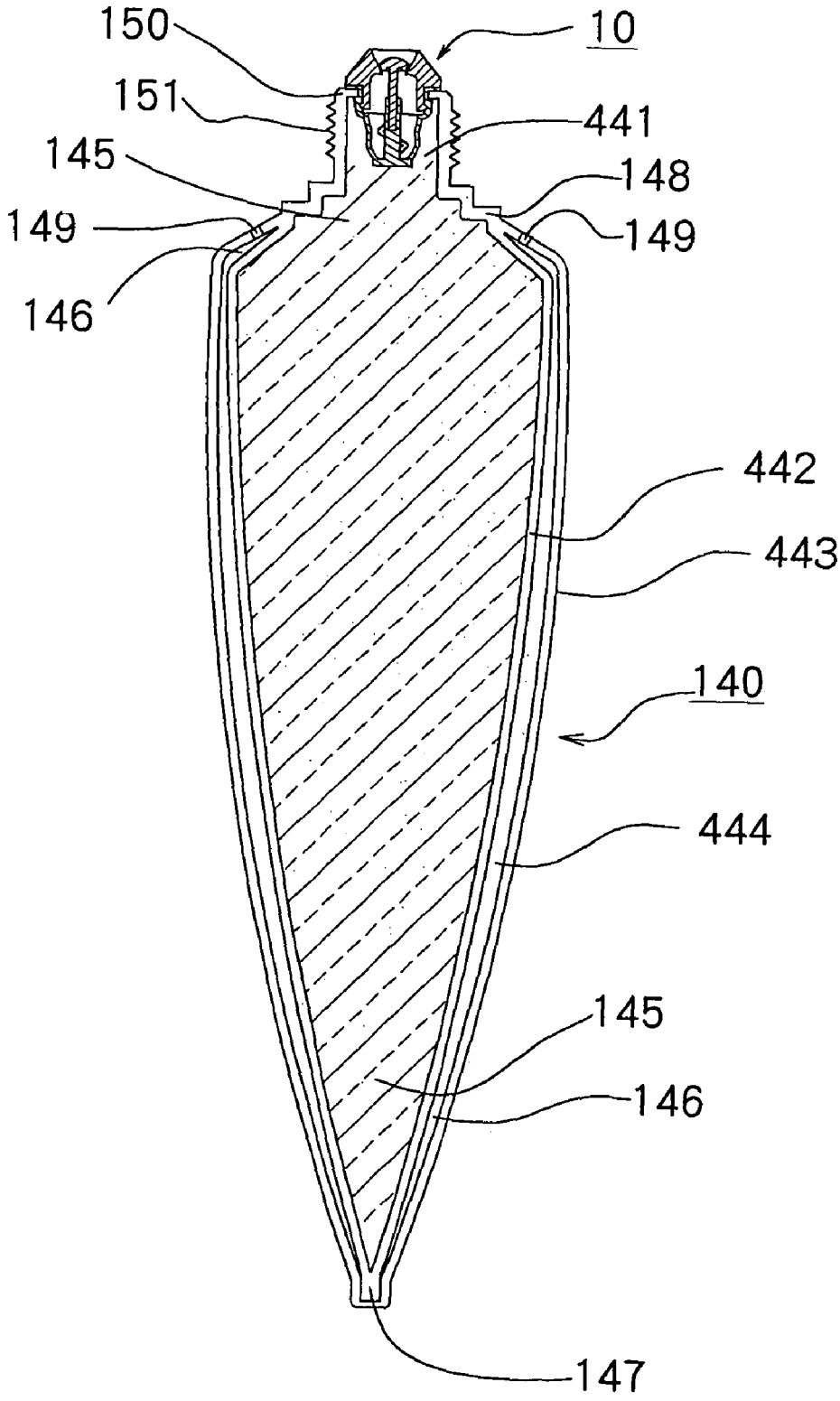
FIG. 28 is a lateral section showing a position before a pressure is applied to the tube-type fluid container according to Embodiment 4 of the present invention, from which the lid material 110 is omitted.
Figure 29:
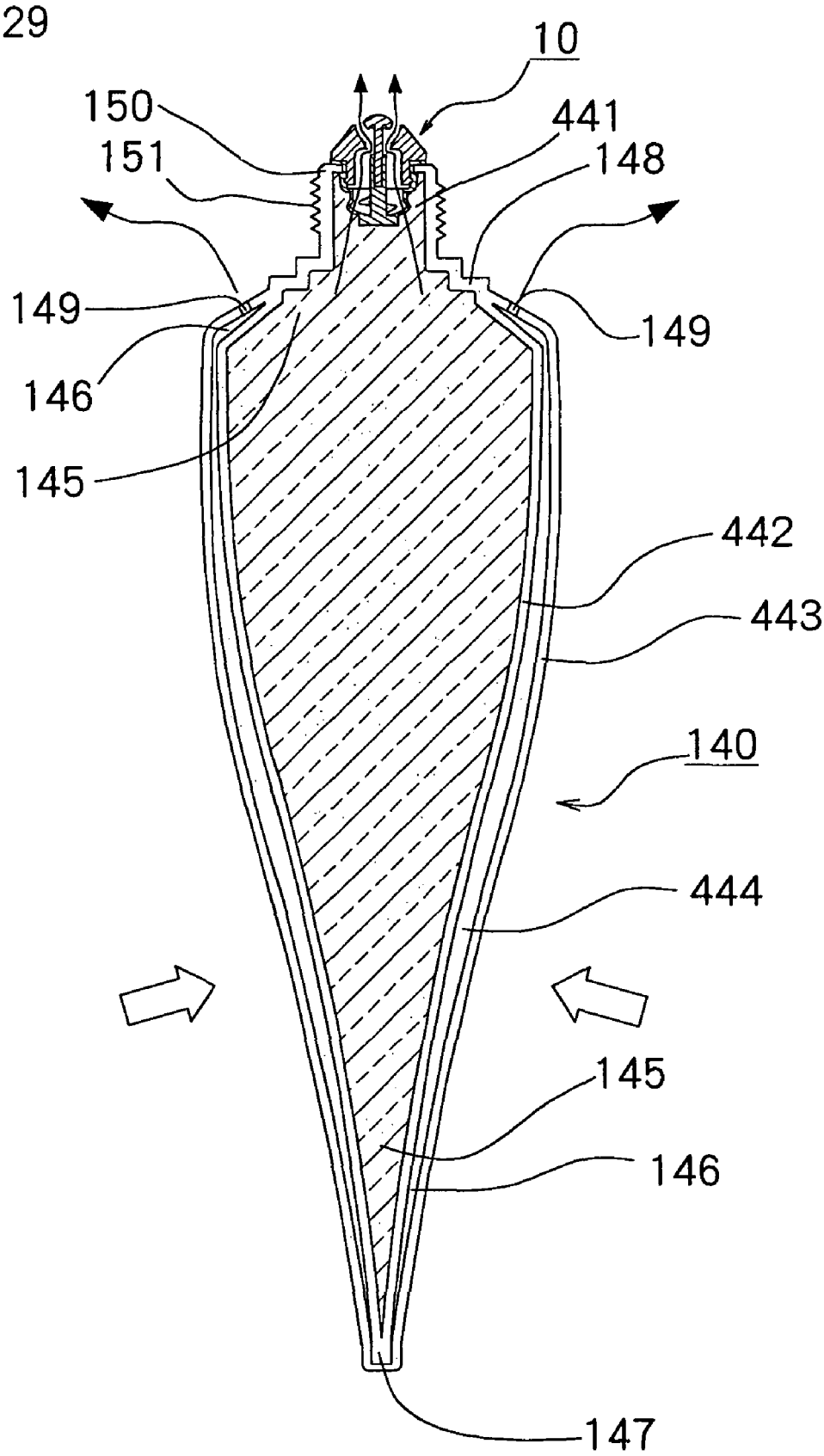
FIG. 29 is a lateral section showing a position when a pressure is applied to the tube-type fluid container according to Embodiment 4 of the present invention, from which the lid material 110 is omitted.
Figure 30:
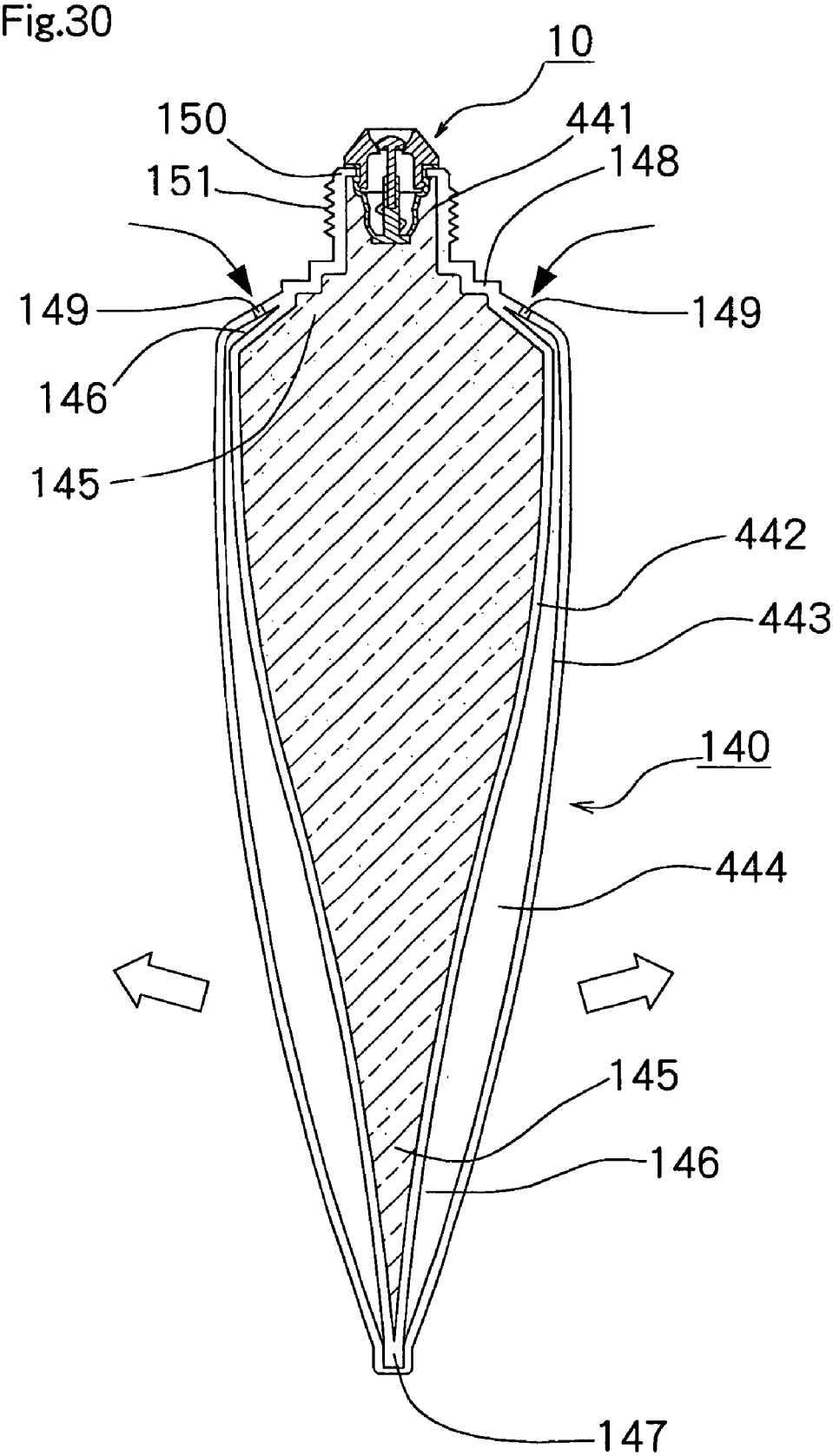
FIG. 30 is a lateral section showing a position when a shape of the external container 443 in the tube-type fluid container according to Embodiment 4 of the present invention is restored, from which the lid material 110 is omitted.

A construction of the container main unit 140 of the tube-type fluid container according to Embodiment 4 of the present invention is described below. FIG. 28 is a lateral section showing a position before a pressure is applied to the tube-type fluid container according to Embodiment 4 of the present invention, from which the lid material 110 is omitted. FIG. 29 is a lateral section showing a position when a pressure is applied to the tube-type fluid container according to Embodiment 4 of the present invention, from which the lid material 110 is omitted. FIG. 30 is a lateral section showing a position when a shape of the external container 443 in the tube-type fluid container according to Embodiment 4 of the present invention is restored, from which the lid material 110 is omitted.

The container main unit 140 possesses an internal container 442 storing a fluid and an external container 443 encompassing the internal container 442. An internal space 444 which is shut off from the outside is formed between the internal container 442 and the external container 443.

The external container 443 in this container main unit 140 has a construction comprising synthetic resin alone or a lamination of synthetic resin and aluminum, and has an elasticity recovering force which tries to recover its original shape when a pressure applied to it is removed. Further, in the external container 443, a hole 149 which communicates with the interior space and the outside is formed. This hole 149 formed in the external container has a size which can let a small amount of air through.

When a pressure is applied to the container main unit 140 from the position shown in FIG. 28, in which the pressure is not applied, as shown in FIG. 29, the volume of the external container 443 reduces as the volume of the internal container 442 reduces by outflow of the fluid inside the internal container 442. At this time, by the elasticity recovering force of the external container 443, inside the internal space 444 which is shut off from the outside is depressurized. Consequently, as shown in FIG. 30, an amount of the air corresponding to the reduced volume of the external container 443 flows into the internal space 444 from the hole formed in the external container 443, which communicates with the internal space 444 and the outside, restoring the external container 443 to its original shape before the pressure has been applied.

Because this hole 149 has a size which can let a slight amount of the air through, an outflow of the air from the internal space 444 to the outside can be controlled to be small. Consequently, it becomes possible to apply a right pressure to the fluid inside the internal container 442.

The internal container 442 and the external container 443 are both formed/shaped by blow molding, and then an opening portion 145 of the internal container and an opening portion 146 of the external container are connected each other at the welding portion 148 on the discharge port side of the container main unit 140 and are welded at a welding portion 147 on the bottom side. Consequently, it becomes possible to manufacture tube-type fluid containers at low costs.

Figure 31:
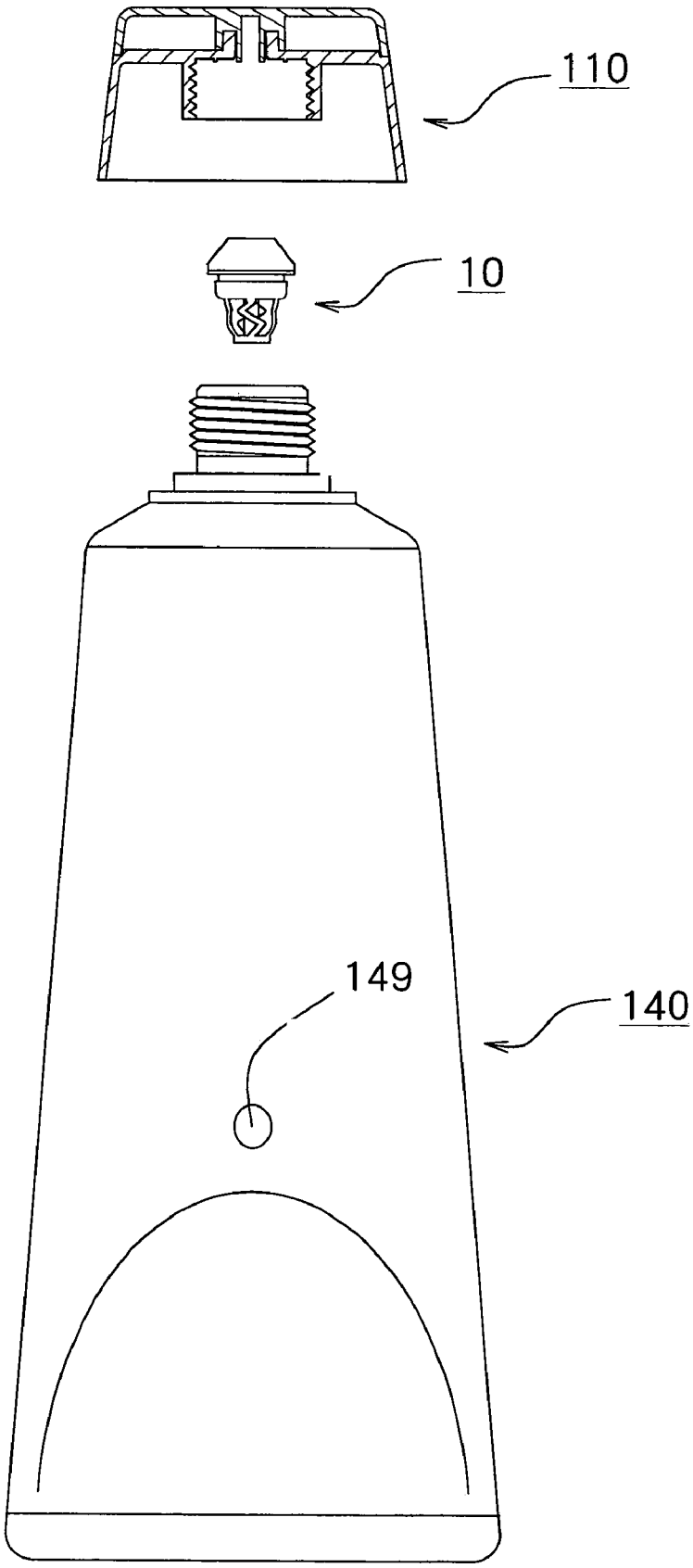
FIG. 31 is a front view of the tube-type fluid container according to Embodiment 5 of the present invention.
Figure 32:
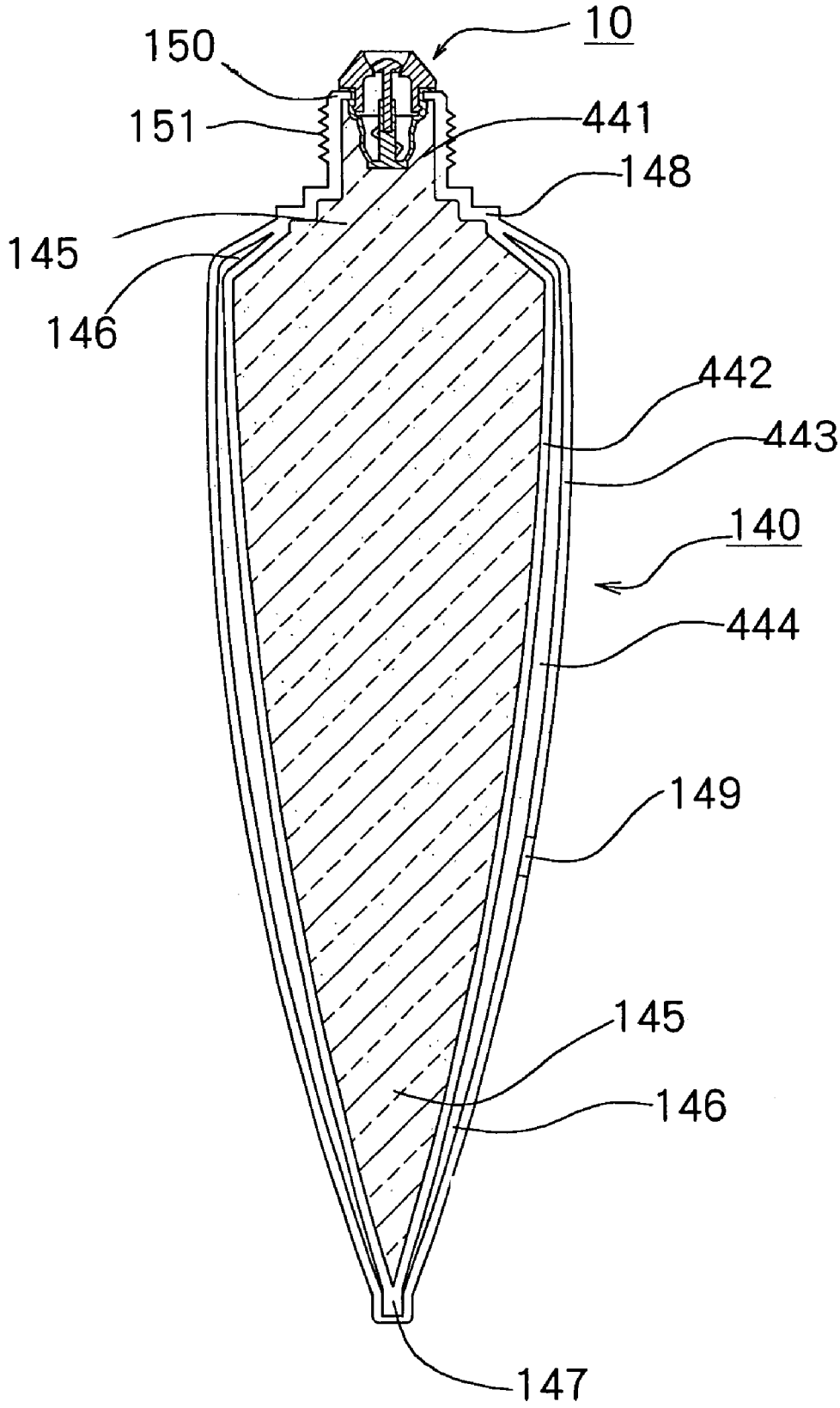
FIG. 32 is a lateral section showing the tube-type fluid container according to Embodiment 5 of the present invention, from which the lid material 110 is omitted.
Figure 33:
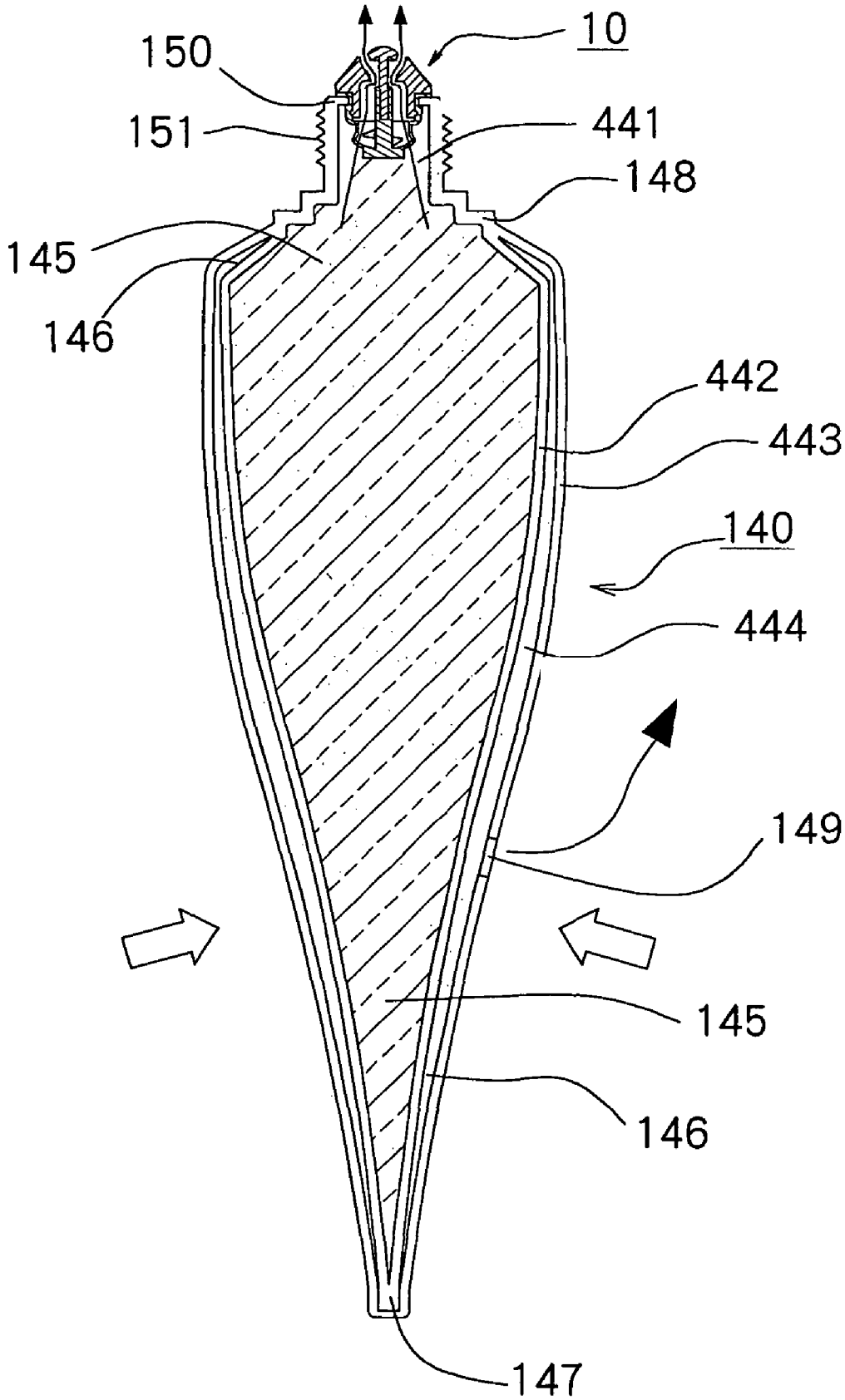
FIG. 33 is a lateral section showing a position when a pressure is applied to the tube-type fluid container according to Embodiment 5 of the present invention, from which the lid material 110 is omitted.
Figure 34:
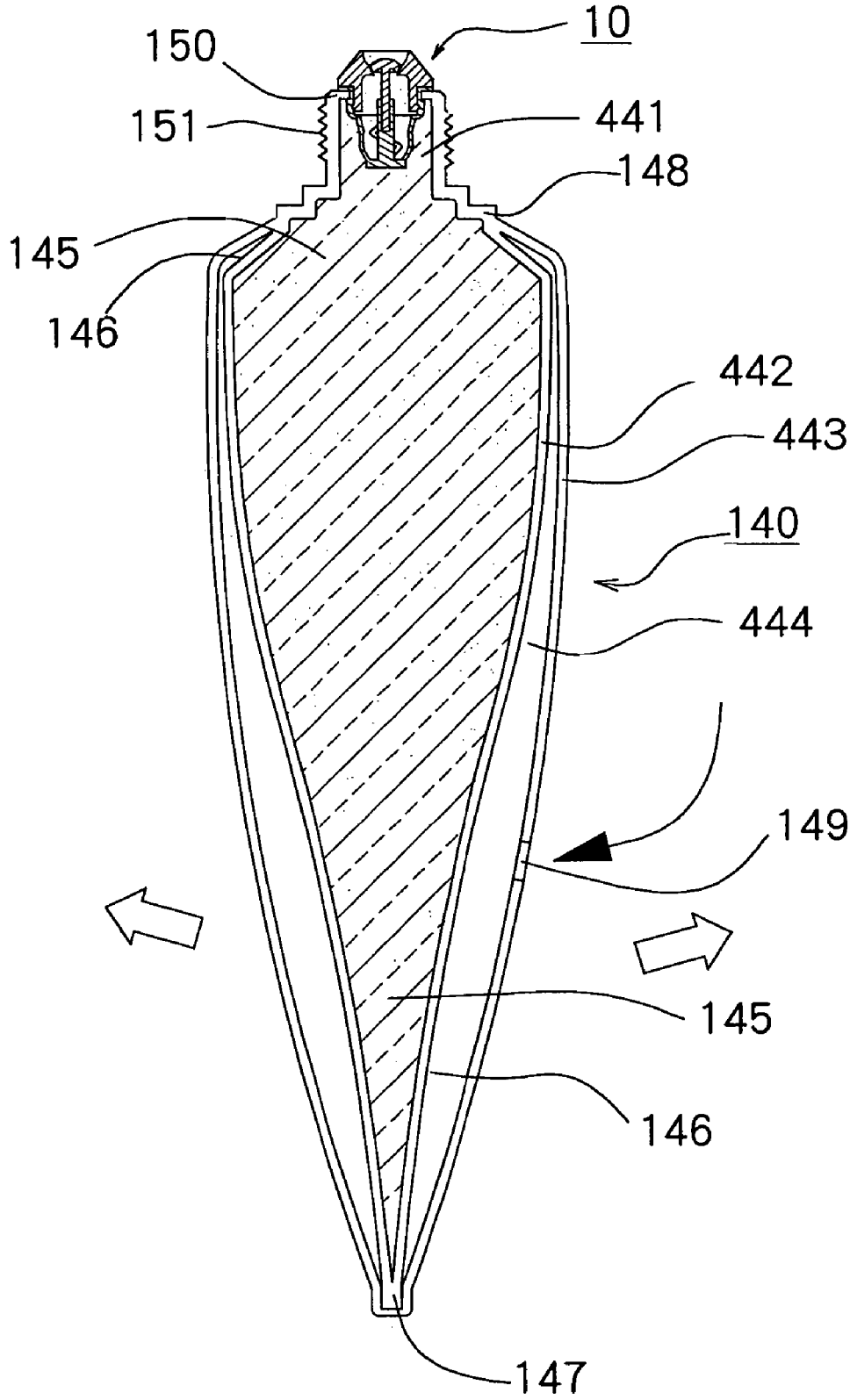
FIG. 34 is a lateral section showing a position when a shape of the external container 443 in the tube-type fluid container according to Embodiment 5 of the present invention is restored, from which the lid material 110 is omitted.

The tube-type fluid container according to Embodiment 5 of the present invention is described below. FIG. 31 is a front view of the tube-type fluid container according to Embodiment 5 of the present invention. FIG. 32 is a lateral section showing the tube-type fluid container according to Embodiment 5 of the present invention, from which the lid material 110 is omitted. FIG. 33 is a lateral section showing a position when a pressure is applied to the tube-type fluid container according to Embodiment 5 of the present invention, from which the lid material 110 is omitted. FIG. 34 is a lateral section showing a position when a shape of the external container 443 in the tube-type fluid container according to Embodiment 4 of the present invention is restored, from which the lid material 110 is omitted. Additionally, a longitudinal section of the tube-type fluid container according to Embodiment 5 of the present invention is the same as the longitudinal section of the tube-type fluid container according to Embodiment 4 of the present invention.

This tube-type fluid container, in the same way as that according to Embodiment 4, possesses an internal container 442 storing a fluid and an external container 443 encompassing the internal container 442. An internal space 444 which is shut off from the outside is formed between the internal container 442 and the external container 443; in the external container 443, a hole 149 which communicates with the interior space and the outside is formed.

The hole 149 formed in the external container 443 at a pressing portion in the external container 443, to which a pressure is applied when a fluid is pushed out. With this construction, when the external container 443 in the container main unit 140 is pressed, a good part of the hole 149 is blocked off, for example, by a pressing object such as a finger; an outflow of the air to the outside from the internal space can be controlled to be small; it becomes possible to apply a right pressure to the fluid inside the internal container 442.

Because a size of the hole 149 should be within the range not exceeding a size of the pressing object, a large amount of the air enters the internal space when the pressing object separates from the pressing portion. By this, the external container 443 can quickly restore its original shape.

Additionally, the valve mechanism applied to the tube-type fluid container according to the present invention is not limited to the valve mechanisms 10 according to respective embodiments described above, but can be applied to any valve mechanisms in which an opening portion is opened when the container main unit 140 is pressed and the opening portion is closed when a pressure applied to the container main unit 140 is removed.

Additionally, for the external container 443, a material with an elasticity recovering force needs to be used. For the internal container 442, a material without an elasticity recovering force can be used.

In the above-mentioned embodiment, a construction in which the opening portions of the internal container 145 and of the external container 146 are connected each other at a welding portion 148 on the discharge port portion side of the container main unit, and the internal container and the external container are welded at their bottoms is adopted. A different construction, in which the container main unit 140 comprising three parts, a discharge port material having the male screw portion 151, the internal container 442 and the external container 443, and the opening portions of the internal container 145 and of the external container 146 are respectively welded to the discharge port material, can also be adopted.

According to the invention described in the fourteenth aspect, because the valve mechanism is provided at the discharge port; with the internal container storing a fluid and the external container comprising a material having an elasticity recovering force, which encompasses the internal container in such a way that an interior space shut off from the outside is formed between the external container and internal container, and in which a hole communicating with the interior space and the outside is formed, despite its simple construction, reverse flow of air from the discharge port of the container into the container can be prevented and the content can be discharged easily even when an amount of the content is reduced.

According to the invention described in the fifteenth aspect, because the hole formed in the external container has a size which can let a small amount of air through, an amount of air outflow from the internal container to the outside can be controlled to be small when the container main unit is pressed, enabling to apply a right pressure to the fluid inside the internal container.

According to the invention described in the sixteenth aspect, because the hole formed in the external container) is formed in a portion to which a pressure is applied when the fluid is discharged, an amount of air outflow from the internal container to the outside can be controlled to be small when the container main unit is pressed, enabling to apply a right pressure to the fluid inside the internal container.

According to the invention described in the seventeenth aspect, because the opening portions of the internal container and of the external container are connected each other at the discharge port portion of the container main unit, and the internal container and the external container are welded at their bottoms, manufacturing a tube-type fluid container at low costs becomes possible.

Figure 37A:
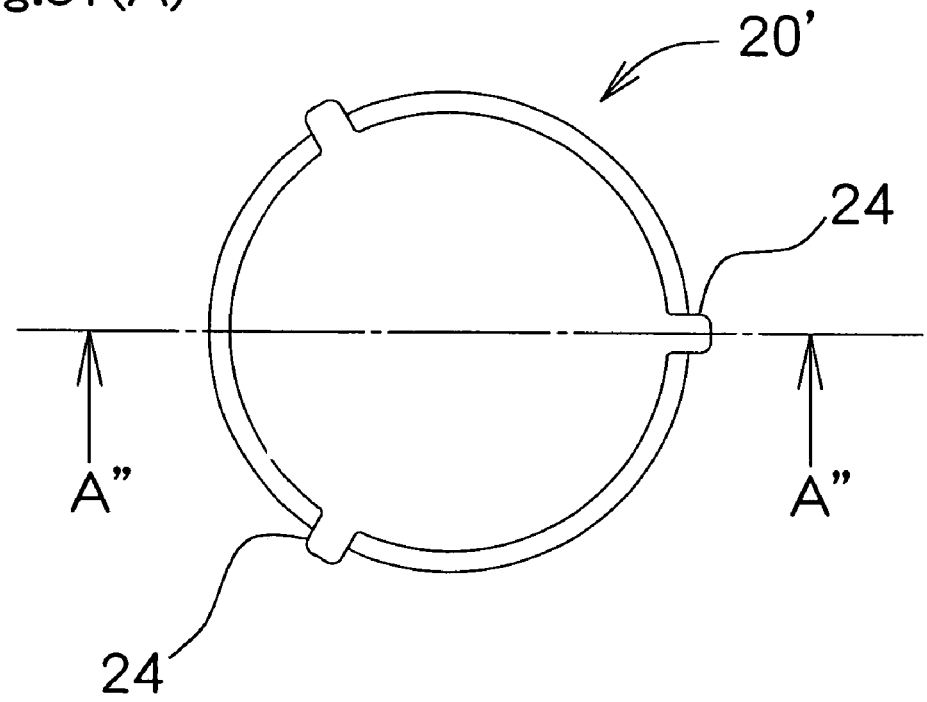
FIG. 37(A) is a bottom view of the valve material 20' according to an alternative embodiment of the present invention.
Figure 37B:
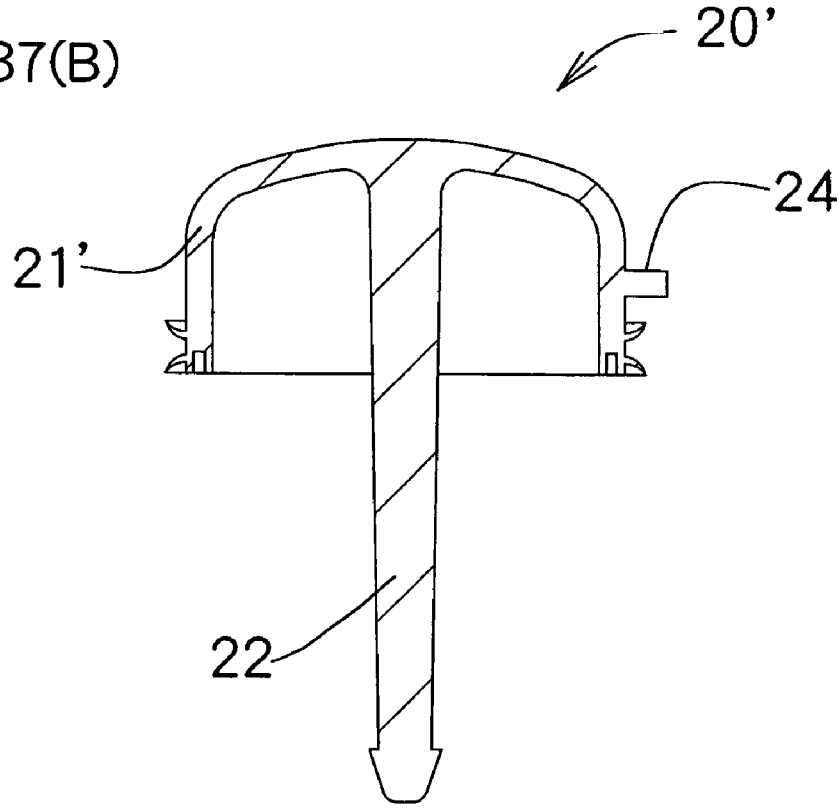
FIG. 37(B) is a longitudinal section showing the A"-A" section in FIG. 37(A).

FIG. 37(A) is a bottom view of the valve material 20' according to an alternative embodiment of the present invention. The valve material 20' has three convex portions 24 facing toward the opening, which is formed in a portion in the valve body 21'. The convex portions 24 contact the valve seat material when the valve body 21' closes the opening. FIG. 37(B) is a longitudinal section showing the A"-A" section in FIG. 37(A).

Figure 38A:
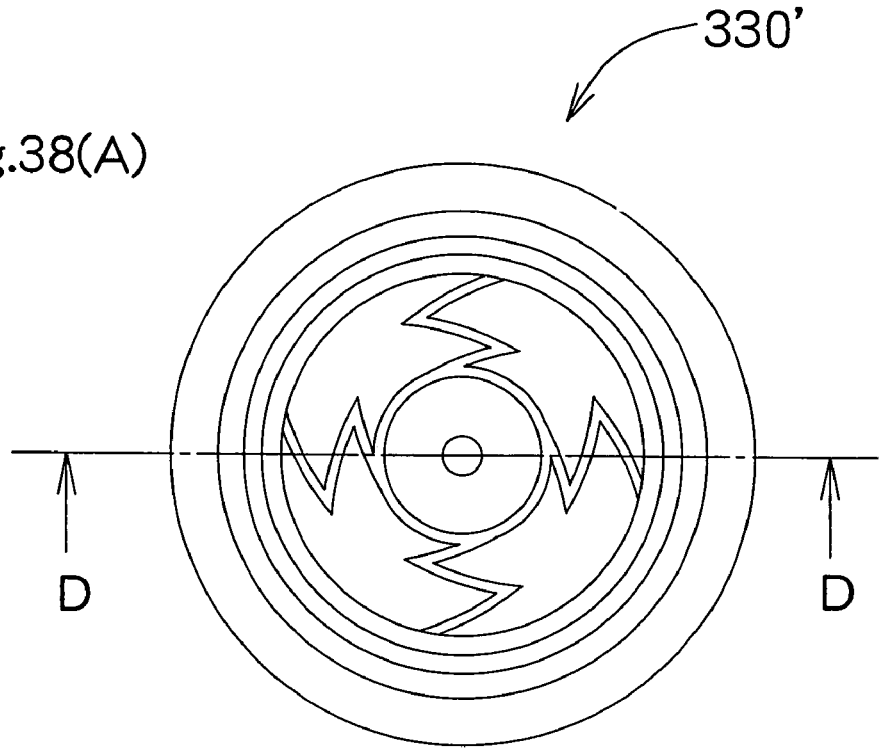
FIG. 38(A) is a plan view of the valve seat material 330' constituting the valve mechanism 10 according to an alternative embodiment of the present invention.
Figure 38B:
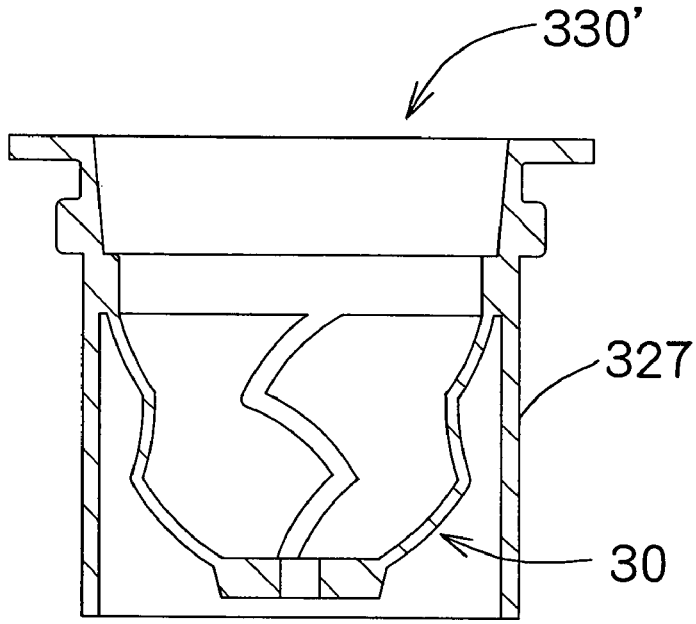
FIG. 38(B) is a longitudinal section showing the D-D section in FIG. 38(A).

FIG. 38(A) is a plan view of the valve seat material 330' constituting the valve mechanism 10 according to an alternative embodiment of the present invention. FIG. 38(B) is a longitudinal section showing the D-D section in FIG. 38(A). The valve seat material 330' has a reinforcing ring 327 which surrounds the coupling material 30. The reinforcing ring 327 can prevent deformation or damage by an extrusion molding. In FIG. 38 (B), portions shown by diagonal lines may be constituted of one part, or different parts.

Figure 39A:
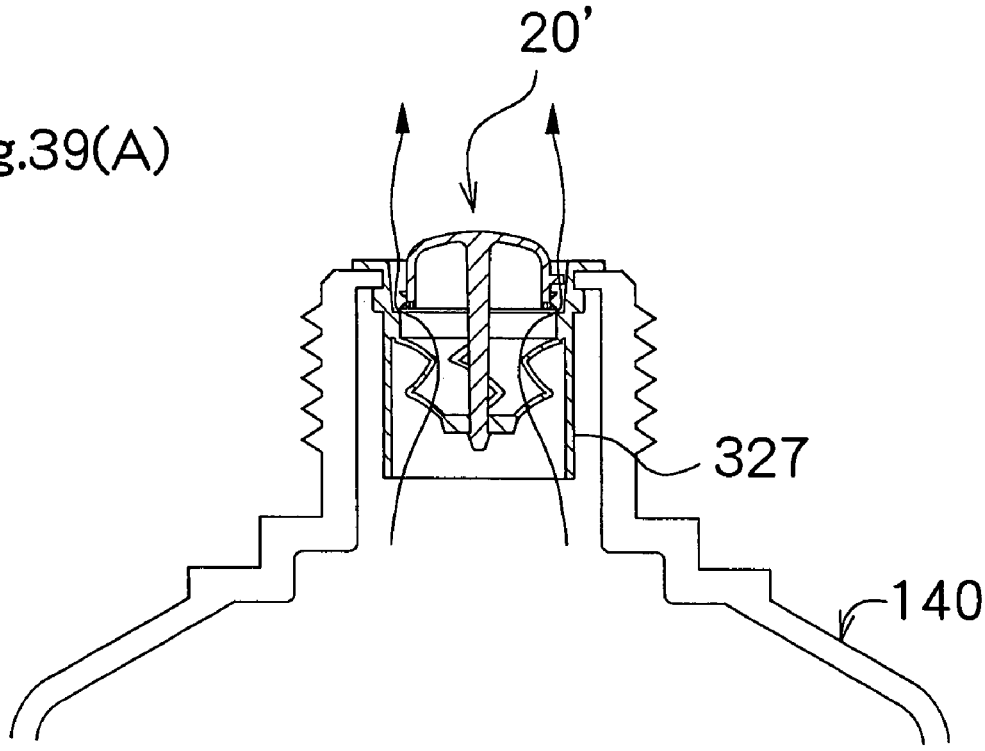
FIGS. 39(A) and 39(B) are longitudinal sections of the relevant part of the tube-type fluid container according to the other embodiment of the present invention.
Figure 39B:
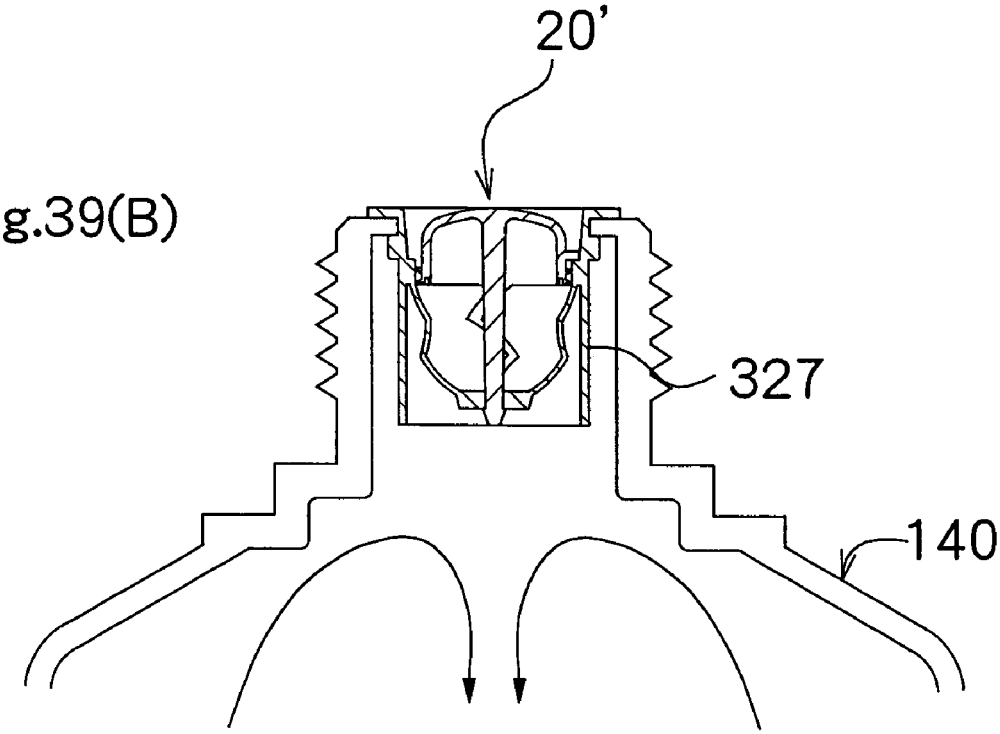

FIG. 39(A) is a longitudinal section of the tube-type fluid container which disposes the valve material 20' shown in FIG. 37(B) and the valve seat material 330' shown in FIG. 38(B). FIG. 39(A) shows that the valve material 20' moves upward to open an opening and a fluid flows through the opening. FIG. 39(B) shows that the valve material 20' moves downward to close the opening, thereby preventing the fluid from flowing through the opening.

Figure 40A:
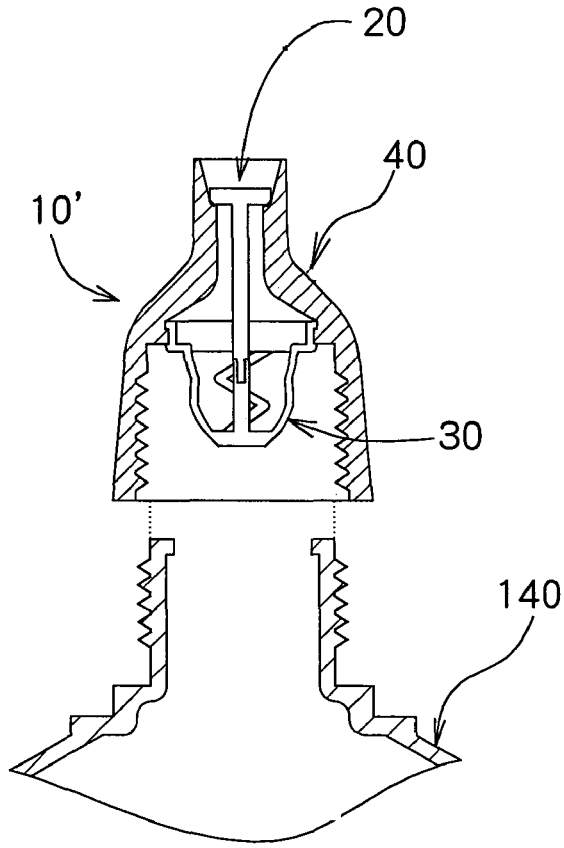
FIGS. 40(A) and 40(B) are longitudinal sections of the relevant part of the tube-type fluid container according to the other embodiment of the present invention.
Figure 40B:
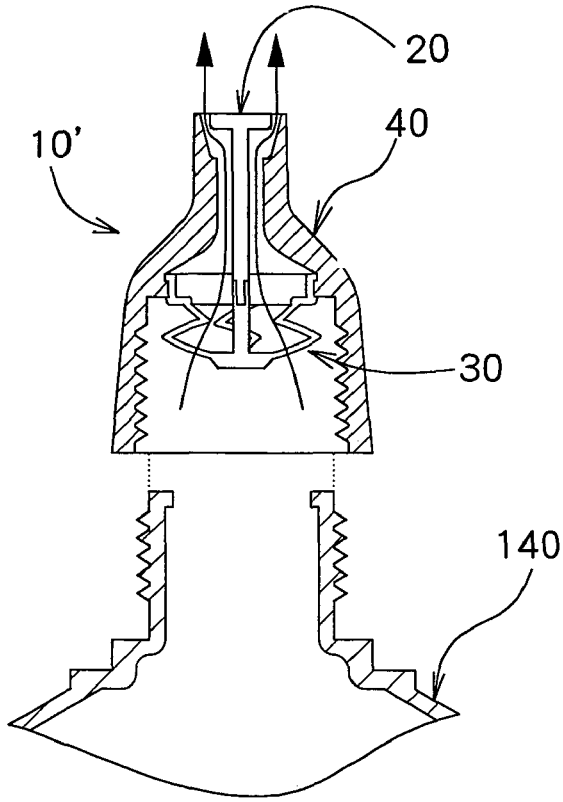

FIG. 40(A) is a longitudinal section of a cap-type valve mechanism 10' comprising a valve material 20, a coupling material 30, and a valve seat material 40. FIG. 40 (A) shows that the valve material 20 moves downward to close an opening, thereby preventing a fluid from flowing through the opening. FIG. 40(B) shows that the valve material 20 moves upward to open the opening and the fluid flows through the opening.

In the present invention, any suitable plastic material can be used including rubbers such as silicon rubbers or soft resins such as soft polyethylene. For support portions (such as the valve seat portion) to which other portions (such as the valve portion) are fitted by press-fitting, hard resins such as hard polyethylene can preferably be used. The structures can be formed by any suitable methods including injection molding. The resin material can be selected based on the type of fluid stored in the container. If a high viscose fluid such as a gel is stored in the container, a hard resin may be used for the valve mechanism. If a low viscose fluid such as a thin liquid or a formed liquid is stored in the container, a more resilient resin may be used for the valve mechanism.

This application claims priority to Japanese patent application Nos. 2002-218330, 2002-330153, 354048 and 2003-28589, filed Jul. 26, 2002, Nov. 14, 2002, Dec. 5, 2002 and Feb. 5, 2003, respectively, the disclosure of which is herein incorporated by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A valve mechanism adapted for a fluid-discharging port of a tube-type fluid container, comprising:

a valve seat portion having an opening for passing a fluid therethrough;

a valve portion comprising a valve body corresponding to said opening to close said opening with the valve body along a circumferential periphery of the valve body, and a shaft connected to said valve body and extending downward from said valve body; and a valve support portion comprising: (i) a bottom plate to which a tip of the shaft is connected; (ii) an annular support fixedly connected to the valve seat portion; and (iii) multiple connectors each connecting the bottom plate and the annular support and having multiple points of flexion, said connectors elastically urging the bottom plate downward to close the opening with the valve body and being bendable at the multiple points of flexion as the bottom plate moves upward and pushes the valve portion to open the opening, wherein said valve portion comprises a guide portion disposed on the side of the valve body opposite to said shaft, and said valve mechanism further comprises a supporting body comprising (a) an opening portion for discharging a fluid and (b) a guide material guiding said guide portion.

2. The valve mechanism as claimed in claim 1, wherein said multiple connectors are composed of three or more connectors.

3. The valve mechanism as claimed in claim 1, wherein a convex portion facing toward said valve body is formed in a portion in said opening, which convex portion contacts said valve body when said valve body closes said opening.

4. The valve mechanism as claimed in claim 1, wherein a convex portion facing toward said opening is formed in a portion in said valve body, which convex portion contacts said valve seat portion when said valve body closes said opening.

5. The valve mechanism as claimed in claim 1, wherein said guide material comprises multiple ribs contacting the outer circumferential surface of said guide portion.

6. The valve mechanism as claimed in claim 1, wherein said valve seat portion contacts both of the bottom surface and the end surface of said valve body in a position in which said valve body closes said opening.

7. The valve mechanism as claimed in claim 1, wherein said multiple connectors are composed of three or more connectors.

8. A tube-type fluid container comprising a tubular container main unit, at one end of which a fluid-discharging port is formed, and the valve mechanism as claimed in claim 1.

9. The tube-type fluid container as claimed in claim 8, wherein said multiple connectors are composed of three or more connectors.

10. The tube-type fluid container as claimed in claim 8, wherein said multiple connectors have flexions.

11. The tube-type fluid container as claimed in claim 8, wherein said container main unit comprises (A) an internal container storing a fluid, and (B) an external container which is composed of a material having an elasticity recovering force and encompasses said internal container in such a way that an interior space shut off from the outside is formed between said external container and said internal container, and in which a hole communicating with said interior space and the outside is formed.

12. The tube-type fluid container as claimed in claim 11, wherein said hole formed in said external container has a size which can let a small amount of air through.

13. The tube-type fluid container as claimed in claim 11, wherein said hole formed in said external container is formed in a portion to which a pressure is applied when the fluid is discharged.

14. The tube-type fluid container as claimed in claim 11, wherein opening portions of said internal container and of said external container are connected to each other at said fluid-discharging port, and said internal container and said external container are welded at their bottoms.

15. The valve mechanism as claimed in claim 1, wherein the flexions are acutely angled at the multiple points.

* * * * *